US010757511B2

(12) United States Patent
Pedersen et al.

(10) Patent No.: US 10,757,511 B2
(45) Date of Patent: Aug. 25, 2020

(54) HEARING DEVICE ADAPTED FOR MATCHING INPUT TRANSDUCERS USING THE VOICE OF A WEARER OF THE HEARING DEVICE

(71) Applicant: Oticon A/S, Smørum (DK)

(72) Inventors: Michael Syskind Pedersen, Smørum (DK); Jesper Jensen, Smørum (DK)

(73) Assignee: OTICON A/S, Smørum (DK)

( * ) Notice: Subject to any disclaimer, the term of this patent is extended or adjusted under 35 U.S.C. 154(b) by 0 days.

(21) Appl. No.: 16/450,629

(22) Filed: Jun. 24, 2019

(65) Prior Publication Data

US 2019/0394577 A1 Dec. 26, 2019

(30) Foreign Application Priority Data

Jun. 25, 2018 (EP) ..... 18179506

(51) Int. Cl.
*H04R 25/00* (2006.01)
*H04R 29/00* (2006.01)

(52) U.S. Cl.
CPC ..... *H04R 25/407* (2013.01); *H04R 25/405* (2013.01); *H04R 25/505* (2013.01);
(Continued)

(58) Field of Classification Search
CPC .... H04R 25/558; H04R 29/006; H04R 25/65; H04R 25/604; H04R 25/505;
(Continued)

(56) References Cited

U.S. PATENT DOCUMENTS

2014/0314258 A1 10/2014 Kamkar Parsi et al.
2018/0054683 A1* 2/2018 Pedersen ..... H04R 1/1041
2018/0262847 A1* 9/2018 Pedersen ..... H04R 25/407

FOREIGN PATENT DOCUMENTS

EP 2 040 486 A2 3/2009
EP 2 040 486 A3 3/2009
(Continued)

*Primary Examiner* — Melur Ramakrishnaiah
(74) *Attorney, Agent, or Firm* — Birch, Stewart, Kolasch & Birch, LLP

(57) ABSTRACT

A hearing device, e.g. a hearing aid, comprises first and second separate, interconnectable parts comprising first and second input transducers, respectively, for providing first and second electric input signals, respectively, representative of sound in an environment of the user, and a beamformer filtering unit configured to provide a spatially filtered signal based thereon, and a memory comprising a previously determined own voice transfer function corresponding to a target sound source located at said user's mouth. The hearing device is configured to determine an updated own voice transfer function according to activation of a predefined trigger, when the user's own voice is present, and to store an updated own voice transfer function in said memory. The hearing device further comprises at least one combination unit configured to apply a first multiplication factor to at least one of the first and second electric input signals, and a control unit configured to determine the first multiplication factor so as to decrease, e.g. minimize a difference measure representative of a difference between the previously determined own voice transfer function and the updated own voice transfer function.

20 Claims, 9 Drawing Sheets

(52) U.S. Cl.
CPC ..... *H04R 25/554* (2013.01); *H04R 25/558* (2013.01); *H04R 25/604* (2013.01); *H04R 25/65* (2013.01); *H04R 29/006* (2013.01); *H04R 2225/021* (2013.01); *H04R 2225/025* (2013.01); *H04R 2225/55* (2013.01)

(58) Field of Classification Search
CPC .. H04R 25/407; H04R 25/554; H04R 25/405; H04R 2225/025; H04R 2225/55; H04R 2225/021
USPC ..... 381/313, 314, 315, 320, 321, 323, 330, 381/91, 92
See application file for complete search history.

(56) References Cited

FOREIGN PATENT DOCUMENTS

| | | | |
|---|---|---|---|
| EP | 2 793 488 | A1 | 10/2014 |
| JP | 6-27993 | A | 2/1994 |

* cited by examiner

HEARING DEVICE ADAPTED FOR MATCHING INPUT TRANSDUCERS USING THE VOICE OF A WEARER OF THE HEARING DEVICE

SUMMARY

The present application relates to a hearing device, e.g. a hearings aid, comprising a multitude of input transducers, e.g. microphones. The present disclosure specifically deals with matching of the multitude of input transducers to facilitate beamforming.

The application relates e.g. to a hearing device comprising a first part (e.g. a BTE part) containing at least one microphone ($M_{BTE}$) and a second part (e.g. an ITE part), electrically connected (e.g. by a cable) to, but physically separate from, the first part, containing a receiver and/or at least one microphone ($M_{ITE}$). When the person wearing the hearing device is talking, the speech will be altered by the acoustic transfer function between the mouth and the microphone(s) as well as by the different characteristics of the microphone(s). The transfer function describing the difference between the transfer functions from a given look direction is given by the look vector d (also termed 'steering vector'). As illustrated in FIG. 1A, $H_1$ denotes the transfer function between the sound from the mouth and the sound picked up by the ITE microphone, and $H_2$ denotes the transfer function between the sound from the mouth and the sound picked up by the BTE microphone. FIG. 1B shows the situation, where the ITE microphone (or a unit comprising the ITE microphone) has been changed. In that case, we assume that the transfer function between the mouth and the BTE microphone is unaltered, but due to a possible different characteristic of the ITE microphone, the transfer function $H'_1$ between the mouth and the output of the ITE microphone will be changed compared to $H_1$. As the look vector is proportional to the transfer function vector, look vector d' will be changed compared to d. In an embodiment, the second part comprises a loudspeaker (also termed 'receiver'). Alternatively, one could as well imagine that the receiver (or just the connecting element between the ITE-part and the BTE-part) has been replaced, but the length of the cable or wire(s) (between the BTE and ITE parts) is different. In that case, the position of the BTE part is likely to change. In such case, it is more likely that the transfer function H1 between the mouth and the ITE microphone is the same, but that the transfer function H2 between the mouth and the BTE microphone is altered. In both cases, the look vector will be altered. It may be advantageous to communicate characteristics of the (first part) ITE-part (e.g. a configuration of microphone and/or loudspeaker/receiver) and/or the connecting element (e.g. a length of the cable or wires, e.g. a receiver cable length) to the (second part) BTE part.

A Hearing Device:

In an aspect of the present application, a hearing device, e.g. a hearing aid, configured to be worn by a user is provided. The hearing device comprises first and second separate parts, the first part comprising a first input transducer providing a first electric input signal representative of sound in an environment of the user, and the second part comprising a second input transducer providing a second electric input signal representative of sound in the environment of the user, wherein the first and second parts are electrically connectable with each other via a wired or wireless connection. The hearing device further comprises, a beamformer filtering unit configured to receive said first and second electric input signals and to provide a spatially filtered signal based thereon;

a memory comprising a previously determined own voice transfer function corresponding to a target sound source located at said user's mouth;

wherein said hearing device is configured to determine an updated own voice transfer function according to activation of a predefined trigger, when the user's own voice is present, and to store an updated own voice transfer function, e.g. a relative transfer function, in said memory, and at least one combination unit configured to apply a first multiplication factor to at least one of said first and second electric input signals, and a control unit configured to determine said first, possibly complex, multiplication factor so as to decrease, such as minimize, a difference measure representative of a difference between said previously determined own voice transfer function and said updated own voice transfer function.

The own voice transfer function (and the updated own voice transfer function) may e.g. be a relative transfer function.

Thereby an improved hearing device may be provided.

Instead of applying a (first) multiplication factor, the set of beamformer weights may simply be updated. This addresses a case, where the replacement of the first part (e.g. comprising an ITE microphone) has influenced the position of all microphones, e.g. if a connecting element between the first and second parts (e.g. a receiver cable length) has been changed.

The transfer function may be represented by a look vector $\underline{d}(k,m)$ in the form of an M-dimensional vector comprising elements (i=1, 2, . . . , M, M being the number of input transducers, e.g. microphones of the hearing device or system), the $i^{th}$ element $d_i(k,m)$ defining a) an acoustic transfer function from the target signal source (e.g. a user's mouth) to the $i^{th}$ input transducer (e.g. a microphone), or b) the relative acoustic transfer function from the $i^{th}$ input transducer to a reference input transducer. The vector element $d_i(k,m)$ is typically a complex number for a specific frequency (k) and time unit (m). The look vector d(k,m) may be estimated from the inter input transducer covariance matrix $\hat{R}_{ss}(k,m)$ based on the signals $s_i(k,m)$, i=1, 2, . . . , M measured at the respective input transducers when the target or calibration signal (here a user's own voice) is active, cf. e.g. EP2882204B1 and EP2701145A1.

The term 'decrease, such as minimize, a difference measure' is in the present context taken to include the process of adapting the multiplication factor ($\alpha$) to provide that the difference between the previously determined own voice transfer function and the updated own voice transfer function is decreased (e.g. minimized).

In an embodiment, the hearing device comprises a (first) BTE part adapted for being located at or behind an ear and a (second) ITE part adapted for being located at or in an ear canal of a user, each part comprising at least one microphone (e.g. $M_{BTE}$ and $M_{ITE}$, respectively, in FIGS. 1A, 1B). In this case, after an exchange of one of the BTE or ITE microphones, a complex (frequency dependent) scaling factor $\alpha_{ITE}(k)$ or $\alpha_{BTE}(k)$ that minimizes the squared difference $\|d_{ov,ref,ITE-BTE}-\alpha_{ov,ITE}d'_{ov,ITE-BTE}\|^2$ is determined, where it is assumed that the BTE microphone ($M_{BTE}$) is a reference microphone, so that $d_{ov}=(1, d_{ov,ITE-BTE})$. In an embodiment, a reference own voice look vector $d_{ov,ref}(1, d_{ov,ref,ITE-BTE})$ is known (determined) in advance of use of the hearing device, whereas $d'_{ov}(d'_{ov,ITE-BTE})$ is estimated during use from the own voice transfer function, e.g. after exchange of one of the microphones. In practice the current own voice look vector may be determined from the input transducer covariance matrix $\hat{R}_{ss}(k,m)$ based on the signals $IN_i(k,m)$, i=BTE, ITE). Assuming that the difference in the microphone response is causing the change from $d_{ov,ref}$ to $d'_{ov}$, we can scale one of the microphones by $\alpha$ (e.g. $\alpha_{ov,ITE}$), such that we do not have to change the acoustic calibration, cf. e.g. FIG. 6.

The first part may be constituted by or comprise an ITE part configured to be located at or in an ear canal of the user. The first part (e.g. an ITE-part) may contain more than one input transducer, e.g. microphones, e.g. two or more.

The second part may be constituted by or comprise a BTE part configured to be located at or behind an ear of the user. The second part (e.g. a BTE-part) may contain more than one input transducer, e.g. microphones, e.g. two or more. The second part, e.g. a BTE part, may contain or comprise two input transducers, e.g. microphones.

The hearing device may comprise a connecting element configured to electrically connect the first and second parts via one or more electrical conductors. The first part (e.g. an ITE-part) and the second part (e.g. a BTE-part) may be electrically connected to each other via respective mating connectors. The first and the second parts and/or the connecting element may be adapted to allow the first and second parts to be reversibly electrically connected to and disconnected from each other. As we have different receiver types (related to size of hearing loss or length of interconnecting element, e.g. cable), taking the receiver type into account while estimating the matching coefficient could help separate the microphone response differences from a difference due to e.g. a different receiver cable length. In an embodiment the type of microphone unit and/or cable length is communicated to the signal processing unit.

The hearing device may be configured to provide that the predefined trigger is activated by a power-on of the hearing device.

The hearing device may be configured to provide that the predefined trigger is activated when the first and second units are electrically connected after having been electrically disconnected.

The hearing device may be configured to provide that the predefined trigger is activated when the first and/or the second input transducers have been replaced. The hearing device may be configured to provide that the predefined trigger is activated when the first and/or the second parts have been replaced.

In an embodiment, the hearing device comprises a user interface. The user interface may be configured to allow a user to activate a calibration mode of the microphones, as proposed by the present disclosure. The user interface may be configured to allow a user to generate the predefined trigger, e.g. by indicating that the first and/or second parts have/has been replaced.

The hearing device may be configured to provide that re-matching of a replaced first or second input transducer is provided by replacing a previously used own voice look vector d stored in the memory, by an updated own voice look vector d', where the updated own voice look vector d' is determined by applying a, generally complex-valued, frequency-dependent scaling factor to the electric input signal of the replaced first or second input transducer such that the squared difference $\|d-\alpha_1 d'\|^2$ is decreased, e.g. minimized. It emphasized that we only scale elements of the normalized look vector, which are different from 1. The re-matching of input transducers of the hearing device may be performed in a particular calibration mode of operation of the hearing device, where the user is instructed to activate his or her own voice, e.g. to speak a certain number of sentences or to speak for a certain time period (cf. e.g. FIG. 5B). During the calibration mode, other changes (than the replacement of one of the input transducers) to the acoustic and electric propagation path(s) from the user's mouth to the electric output of the input transducers of the hearing device should preferably be minimized. In an embodiment, the calibration mode may be controlled via the user interface.

The hearing device may comprise an own voice detector for estimating whether or not, or with what probability, a given input sound originates from the voice of the user of the hearing device.

The hearing device may be constituted by or comprise a hearing aid, a headset, an earphone, an ear protection device or a combination thereof.

In an embodiment, the hearing device is adapted to provide a frequency dependent gain and/or a level dependent compression and/or a transposition (with or without frequency compression) of one or more frequency ranges to one or more other frequency ranges, e.g. to compensate for a hearing impairment of a user. In an embodiment, the hearing device comprises a signal processor for enhancing the input signals and providing a processed output signal.

In an embodiment, the hearing device comprises an output unit for providing a stimulus perceived by the user as an acoustic signal based on a processed electric signal. In an embodiment, the output unit comprises a number of electrodes of a cochlear implant or a vibrator of a bone conducting hearing device. In an embodiment, the output unit comprises an output transducer. In an embodiment, the output transducer comprises a receiver (loudspeaker) for providing the stimulus as an acoustic signal to the user. In an embodiment, the output transducer comprises a vibrator for providing the stimulus as mechanical vibration of a skull bone to the user (e.g. in a bone-attached or bone-anchored hearing device).

In an embodiment, the first and second input transducers comprises first and second microphones, respectively. Each microphone is conjured to convert an input sound to an electric input signal.

In an embodiment, the first and/or second parts comprises a wireless receiver for receiving a wireless signal comprising sound and for providing an electric input signal representing said sound.

In an embodiment, the hearing device comprises a directional microphone system adapted to spatially filter sounds from the environment, and thereby enhance a target acoustic source among a multitude of acoustic sources in the local environment of the user wearing the hearing device. In an embodiment, the directional system is adapted to detect (such as adaptively detect) from which direction a particular part of the microphone signal originates. This can be achieved in various different ways as e.g. described in the prior art. In hearing devices, a microphone array beamformer is often used for spatially attenuating background noise sources. Many beamformer variants can be found in literature. The minimum variance distortionless response (MVDR) beamformer is widely used in microphone array signal processing. Ideally, the MVDR beamformer keeps the signals from the target direction (also referred to as the look direction) unchanged, while attenuating sound signals from other directions maximally. The generalized sidelobe canceller (GSC) structure is an equivalent representation of the MVDR beamformer offering computational and numerical advantages over a direct implementation in its original form.

In an embodiment, the hearing device comprises an antenna and transceiver circuitry (e.g. a wireless receiver) for wirelessly receiving a direct electric input signal from another device, e.g. from an entertainment device (e.g. a TV-set), a communication device, a wireless microphone, or another hearing device. In an embodiment, the direct electric input signal represents or comprises an audio signal and/or a control signal and/or an information signal.

In an embodiment, the hearing device is a portable device, e.g. a device comprising a local energy source, e.g. a battery, e.g. a rechargeable battery.

In an embodiment, the hearing device comprises a forward or signal path between an input unit (e.g. an input transducer, such as a microphone or a microphone system and/or direct electric input (e.g. a wireless receiver)) and an output unit, e.g. an output transducer. In an embodiment, the signal processor is located in the forward path. In an embodiment, the signal processor is adapted to provide a frequency dependent gain according to a user's particular needs. In an embodiment, the hearing device comprises an analysis path comprising functional components for analyzing the input signal (e.g. determining a level, a modulation, a type of signal, an acoustic feedback estimate, etc.). In an embodiment, some or all signal processing of the analysis path and/or the signal path is conducted in the frequency domain. In an embodiment, some or all signal processing of the analysis path and/or the signal path is conducted in the time domain.

In an embodiment, an analogue electric signal representing an acoustic signal is converted to a digital audio signal in an analogue-to-digital (AD) conversion process, where the analogue signal is sampled with a predefined sampling frequency or rate $f_s$, $f_s$ being e.g. in the range from 8 kHz to 48 kHz (adapted to the particular needs of the application) to provide digital samples $x_n$ (or x[n]) at discrete points in time $t_n$ (or n), each audio sample representing the value of the acoustic signal at to by a predefined number $N_b$ of bits, $N_b$ being e.g. in the range from 1 to 48 bits, e.g. 24 bits. Each audio sample is hence quantized using $N_b$ bits (resulting in $2^{Nb}$ different possible values of the audio sample). A digital sample x has a length in time of $1/f_s$, e.g. 50 μs, for $f_s$=20 kHz. In an embodiment, a number of audio samples are arranged in a time frame. In an embodiment, a time frame comprises 64 or 128 audio data samples. Other frame lengths may be used depending on the practical application.

In an embodiment, the hearing devices comprise an analogue-to-digital (AD) converter to digitize an analogue input (e.g. from an input transducer, such as a microphone) with a predefined sampling rate, e.g. 20 kHz. In an embodiment, the hearing devices comprise a digital-to-analogue (DA) converter to convert a digital signal to an analogue output signal, e.g. for being presented to a user via an output transducer.

In an embodiment, the hearing device, e.g. the microphone unit, and or the transceiver unit comprise(s) a TF-conversion unit for providing a time-frequency representation of an input signal. In an embodiment, the time-frequency representation comprises an array or map of corresponding complex or real values of the signal in question in a particular time and frequency range. In an embodiment, the TF conversion unit comprises a filter bank for filtering a (time varying) input signal and providing a number of (time varying) output signals each comprising a distinct frequency range of the input signal. In an embodiment, the TF conversion unit comprises a Fourier transformation unit for converting a time variant input signal to a (time variant) signal in the (time-)frequency domain. In an embodiment, the frequency range considered by the hearing device from a minimum frequency $f_{min}$ to a maximum frequency $f_{max}$ comprises a part of the typical human audible frequency range from 20 Hz to 20 kHz, e.g. a part of the range from 20 Hz to 12 kHz. Typically, a sample rate $f_s$ is larger than or equal to twice the maximum frequency $f_{max}$, $f_s \geq 2f_{max}$. In an embodiment, a signal of the forward and/or analysis path of the hearing device is split into a number NI of frequency bands (e.g. of uniform width), where NI is e.g. larger than 5, such as larger than 10, such as larger than 50, such as larger than 100, such as larger than 500, at least some of which are processed individually. In an embodiment, the hearing device is/are adapted to process a signal of the forward and/or analysis path in a number NP of different frequency channels (NP≤NI). The frequency channels may be uniform or non-uniform in width (e.g. increasing in width with frequency), overlapping or non-overlapping.

In an embodiment, the hearing device comprises a number of detectors configured to provide status signals relating to a current physical environment of the hearing device (e.g. the current acoustic environment), and/or to a current state of the user wearing the hearing device, and/or to a current state or mode of operation of the hearing device. Alternatively or additionally, one or more detectors may form part of an external device in communication (e.g. wirelessly) with the hearing device. An external device may e.g. comprise another hearing device, a remote control, and audio delivery device, a telephone (e.g. a Smartphone), an external sensor, etc.

In an embodiment, one or more of the number of detectors operate(s) on the full band signal (time domain). In an embodiment, one or more of the number of detectors operate(s) on band split signals ((time-) frequency domain), e.g. in a limited number of frequency bands.

In an embodiment, the number of detectors comprises a level detector for estimating a current level of a signal of the forward path. In an embodiment, the predefined criterion comprises whether the current level of a signal of the forward path is above or below a given (L-)threshold value. In an embodiment, the level detector operates on the full band signal (time domain). In an embodiment, the level detector operates on band split signals ((time-) frequency domain).

In a particular embodiment, the hearing device comprises a voice detector (VD) for estimating whether or not (or with what probability) an input signal comprises a voice signal (at a given point in time). A voice signal is in the present context taken to include a speech signal from a human being. It may also include other forms of utterances generated by the human speech system (e.g. singing). In an embodiment, the voice detector unit is adapted to classify a current acoustic environment of the user as a VOICE or NO-VOICE environment. This has the advantage that time segments of the electric microphone signal comprising human utterances (e.g. speech) in the user's environment can be identified, and thus separated from time segments only (or mainly) comprising other sound sources (e.g. artificially generated noise). In an embodiment, the voice detector is adapted to detect as a VOICE also the user's own voice. Alternatively, the voice detector is adapted to exclude a user's own voice from the detection of a VOICE.

In an embodiment, the hearing device comprises an own voice detector for estimating whether or not (or with what probability) a given input sound (e.g. a voice, e.g. speech) originates from the voice of the user of the system. In an embodiment, a microphone system of the hearing device is adapted to be able to differentiate between a user's own voice and another person's voice and possibly from NON-voice sounds.

Detection of a user's own voice can be done in a number of different ways, see e.g. use of sensors, e.g. acceleration sensor, vibration sensor, etc. or using signals from microphones at both ears (binaural detection, cf. e.g. US2006262944A1), determining a direct-to-reverberant ratio between the signal energy of a direct sound part and that of a reverberant sound part of an input sound signal (cf. e.g. US2008189107A1). The detection of a user's own voice is preferably independent of the parameter(s) (e.g. $\alpha_{ITE}$, $\alpha_{BTE}$, cf. e.g. FIG. 3) multiplied to the input signals (e.g. to $IN_{ITE}$, $IN_{BTE}$ in FIG. 3) for the purpose of microphone matching.

In an embodiment, the number of detectors comprises a movement detector, e.g. an acceleration sensor. In an embodiment, the movement detector is configured to detect movement of the user's facial muscles and/or bones, e.g. due to speech or chewing (e.g. jaw movement) and to provide a detector signal indicative thereof.

In an embodiment, the hearing device comprises a classification unit configured to classify the current situation based on input signals from (at least some of) the detectors, and possibly other inputs as well. In the present context 'a current situation' is taken to be defined by one or more of a) the physical environment (e.g. including the current electromagnetic environment, e.g. the occurrence of electromagnetic signals (e.g. comprising audio and/or control signals) intended or not intended for reception by the hearing device, or other properties of the current environment than acoustic);

b) the current acoustic situation (input level, feedback, etc.), and c) the current mode or state of the user (movement, temperature, cognitive load, etc.);

d) the current mode or state of the hearing device (program selected, time elapsed since last user interaction, etc.) and/or of another device in communication with the hearing device.

In an embodiment, the hearing device comprises an acoustic (and/or mechanical) feedback suppression system.

In an embodiment, the hearing device further comprises other relevant functionality for the application in question, e.g. compression, noise reduction, etc.

In an embodiment, the hearing device comprises a listening device, e.g. a hearing aid, e.g. a hearing instrument, e.g. a hearing instrument adapted for being located at the ear or fully or partially in the ear canal of a user, e.g. a headset, an earphone, an ear protection device or a combination thereof.

Use:

In an aspect, use of a hearing device as described above, in the 'detailed description of embodiments' and in the claims, is moreover provided. In an embodiment, use is provided in a system comprising audio processing. In an embodiment, use is provided in a system comprising one or more hearing aids (e.g. hearing instruments), headsets, ear phones, active ear protection systems, etc., e.g. in handsfree telephone systems, teleconferencing systems, public address systems, karaoke systems, classroom amplification systems, etc.

A method:

In an aspect, a method of matching input transducers of a hearing device, e.g. a hearing aid, configured to be worn by a user is furthermore provided by the present application. The hearing device comprises first and second separate parts, the first part comprising a first input transducer providing a first electric input signal representative of sound in an environment of the user, and the second part comprising a second input transducer providing a second electric input signal representative of sound in the environment of the user, wherein the first and second parts are electrically connectable with each other via a wired or wireless connection. The method comprises receiving said first and second electric input signals;

providing a spatially filtered signal based on said first and second electric input signals;

storing previously determined own voice beamformer weights or an own voice transfer function corresponding to a previously determined or reference own voice beamformer adapted to pick up said user's own voice;

updating said own voice beamformer weights or said own voice transfer function according to activation of a predefined trigger, when the user's own voice is present;

storing said updated own voice beamformer weights or said updated own voice transfer function in said memory;

providing matched first and second electric input signals based on said previously determined own voice beamformer weights or own voice transfer function and said updated own voice beamformer weights or own voice transfer function.

It is intended that some or all of the structural features of the device described above, in the 'detailed description of embodiments' or in the claims can be combined with embodiments of the method, when appropriately substituted by a corresponding process and vice versa. Embodiments of the method have the same advantages as the corresponding devices.

In principle, we could update not only an own voice beamformer, but any beamformer, e.g a target cancelling beamformer. If the only difference between the old and new beamformer weights is the ITE microphone transfer function, this difference would apply to any beamformer.

The transfer function(s) may e.g. be represented by a corresponding look vector. The transfer functions may be relative transfer functions between the microphones of the hearing device. The look vector may comprise as its individual elements relative transfer functions of sound from the sound source to the respective input transducers of the hearing device (taking one of the input transducers as the reference). The own voice transfer function (and the updated own voice transfer function) may e.g. be a relative transfer function.

The predefined trigger may be generated via a user interface and/or by a signal from one or more sensors.

A Computer Readable Medium:

In an aspect, a tangible computer-readable medium storing a computer program comprising program code means for causing a data processing system to perform at least some (such as a majority or all) of the steps of the method described above, in the 'detailed description of embodiments' and in the claims, when said computer program is executed on the data processing system is furthermore provided by the present application.

By way of example, and not limitation, such computer-readable media can comprise RAM, ROM, EEPROM, CD-ROM or other optical disk storage, magnetic disk storage or other magnetic storage devices, or any other medium that can be used to carry or store desired program code in the form of instructions or data structures and that can be accessed by a computer. Disk and disc, as used herein, includes compact disc (CD), laser disc, optical disc, digital versatile disc (DVD), floppy disk and Blu-ray disc where disks usually reproduce data magnetically, while discs reproduce data optically with lasers. Combinations of the above should also be included within the scope of computer-readable media. In addition to being stored on a tangible medium, the computer program can also be transmitted via a transmission medium such as a wired or wireless link or a network, e.g. the Internet, and loaded into a data processing system for being executed at a location different from that of the tangible medium.

A Computer Program:

A computer program (product) comprising instructions which, when the program is executed by a computer, cause the computer to carry out (steps of) the method described above, in the 'detailed description of embodiments' and in the claims is furthermore provided by the present application.

A Data Processing System:

In an aspect, a data processing system comprising a processor and program code means for causing the processor to perform at least some (such as a majority or all) of the steps of the method described above, in the 'detailed description of embodiments' and in the claims is furthermore provided by the present application.

A Hearing System:

In a further aspect, a hearing system comprising a hearing device as described above, in the 'detailed description of embodiments', and in the claims, AND an auxiliary device is moreover provided.

In an embodiment, the hearing system is adapted to establish a communication link between the hearing device and the auxiliary device to provide that information (e.g. control and status signals, possibly audio signals) can be exchanged or forwarded from one to the other.

In an embodiment, the hearing system comprises an auxiliary device, e.g. a remote control, a smartphone, or other portable or wearable electronic device, such as a smartwatch or the like.

In an embodiment, the auxiliary device is or comprises a remote control for controlling functionality and operation of the hearing device(s). In an embodiment, the function of a remote control is implemented in a SmartPhone, the SmartPhone possibly running an APP allowing to control the functionality of the audio processing device via the SmartPhone (the hearing device(s) comprising an appropriate wireless interface to the SmartPhone, e.g. based on Bluetooth or some other standardized or proprietary scheme).

In an embodiment, the auxiliary device is or comprises an audio gateway device adapted for receiving a multitude of audio signals (e.g. from an entertainment device, e.g. a TV or a music player, a telephone apparatus, e.g. a mobile telephone or a computer, e.g. a PC) and adapted for selecting and/or combining an appropriate one of the received audio signals (or combination of signals) for transmission to the hearing device.

In an embodiment, the auxiliary device is or comprises another hearing device. In an embodiment, the hearing system comprises two hearing devices adapted to implement a binaural hearing system, e.g. a binaural hearing aid system.

An APP:

In a further aspect, a non-transitory application, termed an APP, is furthermore provided by the present disclosure. The APP comprises executable instructions configured to be executed on an auxiliary device to implement a user interface for a hearing device or a hearing system described above in the 'detailed description of embodiments', and in the claims. In an embodiment, the APP is configured to run on cellular phone, e.g. a smartphone, or on another portable device allowing communication with said hearing device or said hearing system.

The user interface may be configured to allow the user to interact with the hearing device or system and control functionality of the device or system. The user interface may allow the user to activate a calibration mode (according to the present disclosure), to initiate a calibration procedure, and/or to terminate the calibration procedure, and possibly accept the results of the calibration.

Definitions

In the present context, a 'hearing device' refers to a device, such as a hearing aid, e.g. a hearing instrument, or an active ear-protection device, or other audio processing device, which is adapted to improve, augment and/or protect the hearing capability of a user by receiving acoustic signals from the user's surroundings, generating corresponding audio signals, possibly modifying the audio signals and providing the possibly modified audio signals as audible signals to at least one of the user's ears. A 'hearing device' further refers to a device such as an earphone or a headset adapted to receive audio signals electronically, possibly modifying the audio signals and providing the possibly modified audio signals as audible signals to at least one of the user's ears. Such audible signals may e.g. be provided in the form of acoustic signals radiated into the user's outer ears, acoustic signals transferred as mechanical vibrations to the user's inner ears through the bone structure of the user's head and/or through parts of the middle ear as well as electric signals transferred directly or indirectly to the cochlear nerve of the user.

The hearing device may be configured to be worn in any known way, e.g. as a unit arranged behind the ear with a tube leading radiated acoustic signals into the ear canal or with an output transducer, e.g. a loudspeaker, arranged close to or in the ear canal, as a unit entirely or partly arranged in the pinna and/or in the ear canal, as a unit, e.g. a vibrator, attached to a fixture implanted into the skull bone, as an attachable, or entirely or partly implanted, unit, etc. The hearing device may comprise a single unit or several units communicating electronically with each other. The loudspeaker may be arranged in a housing together with other components of the hearing device, or may be an external unit in itself (possibly in combination with a flexible guiding element, e.g. a dome-like element).

More generally, a hearing device comprises an input transducer for receiving an acoustic signal from a user's surroundings and providing a corresponding input audio signal and/or a receiver for electronically (i.e. wired or wirelessly) receiving an input audio signal, a (typically configurable) signal processing circuit (e.g. a signal processor, e.g. comprising a configurable (programmable) processor, e.g. a digital signal processor) for processing the input audio signal and an output unit for providing an audible signal to the user in dependence on the processed audio signal. The signal processor may be adapted to process the input signal in the time domain or in a number of frequency bands. In some hearing devices, an amplifier and/or compressor may constitute the signal processing circuit. The signal processing circuit typically comprises one or more (integrated or separate) memory elements for executing programs and/or for storing parameters used (or potentially used) in the processing and/or for storing information relevant for the function of the hearing device and/or for storing information (e.g. processed information, e.g. provided by the signal processing circuit), e.g. for use in connection with an interface to a user and/or an interface to a programming device. In some hearing devices, the output unit may comprise an output transducer, such as e.g. a loudspeaker for providing an air-borne acoustic signal or a vibrator for providing a structure-borne or liquid-borne acoustic signal. In some hearing devices, the output unit may comprise one or more output electrodes for providing electric signals (e.g. a multi-electrode array for electrically stimulating the cochlear nerve).

In some hearing devices, the vibrator may be adapted to provide a structure-borne acoustic signal transcutaneously or percutaneously to the skull bone. In some hearing devices, the vibrator may be implanted in the middle ear and/or in the inner ear. In some hearing devices, the vibrator may be adapted to provide a structure-borne acoustic signal to a middle-ear bone and/or to the cochlea. In some hearing devices, the vibrator may be adapted to provide a liquid-borne acoustic signal to the cochlear liquid, e.g. through the oval window. In some hearing devices, the output electrodes may be implanted in the cochlea or on the inside of the skull bone and may be adapted to provide the electric signals to the hair cells of the cochlea, to one or more hearing nerves, to the auditory brainstem, to the auditory midbrain, to the auditory cortex and/or to other parts of the cerebral cortex.

A hearing device, e.g. a hearing aid, may be adapted to a particular user's needs, e.g. a hearing impairment. A configurable signal processing circuit of the hearing device may be adapted to apply a frequency and level dependent compressive amplification of an input signal. A customized frequency and level dependent gain (amplification or compression) may be determined in a fitting process by a fitting system based on a user's hearing data, e.g. an audiogram, using a fitting rationale (e.g. adapted to speech). The frequency and level dependent gain may e.g. be embodied in processing parameters, e.g. uploaded to the hearing device via an interface to a programming device (fitting system), and used by a processing algorithm executed by the configurable signal processing circuit of the hearing device.

A 'hearing system' refers to a system comprising one or two hearing devices, and a 'binaural hearing system' refers to a system comprising two hearing devices and being adapted to cooperatively provide audible signals to both of the user's ears. Hearing systems or binaural hearing systems may further comprise one or more 'auxiliary devices', which communicate with the hearing device(s) and affect and/or benefit from the function of the hearing device(s). Auxiliary devices may be e.g. remote controls, audio gateway devices, mobile phones (e.g. SmartPhones), or music players. Hearing devices, hearing systems or binaural hearing systems may e.g. be used for compensating for a hearing-impaired person's loss of hearing capability, augmenting or protecting a normal-hearing person's hearing capability and/or conveying electronic audio signals to a person. Hearing devices or hearing systems may e.g. form part of or interact with public-address systems, active ear protection systems, handsfree telephone systems, car audio systems, entertainment (e.g. karaoke) systems, teleconferencing systems, classroom amplification systems, etc.

Embodiments of the disclosure may e.g. be useful in applications such as hearing aids and hearing aid systems, e.g. binaural hearing aid systems, in particular such hearing ads or hearing aid systems that comprises at least two separate parts each comprising an input transducer.

BRIEF DESCRIPTION OF DRAWINGS

The aspects of the disclosure may be best understood from the following detailed description taken in conjunction with the accompanying figures. The figures are schematic and simplified for clarity, and they just show details to improve the understanding of the claims, while other details are left out. Throughout, the same reference numerals are used for identical or corresponding parts. The individual features of each aspect may each be combined with any or all features of the other aspects. These and other aspects, features and/or technical effect will be apparent from and elucidated with reference to the illustrations described hereinafter in which:

The figures are schematic and simplified for clarity, and they just show details which are essential to the understanding of the disclosure, while other details are left out. Throughout, the same reference signs are used for identical or corresponding parts.

Figure 1B:
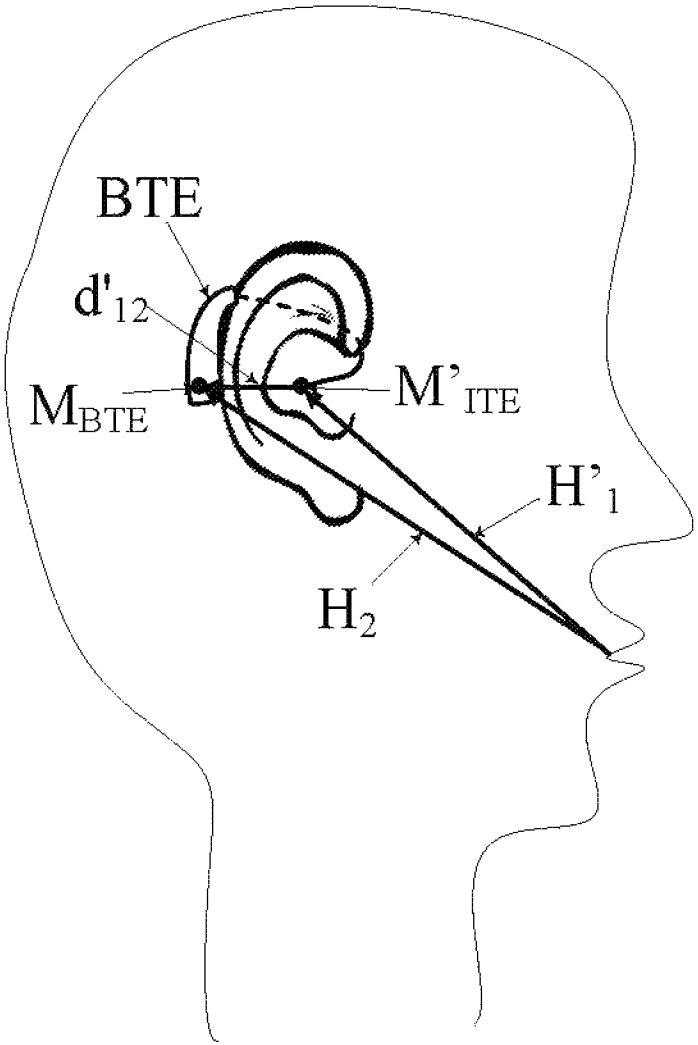
FIG. 1B shows a hearing device comprising a BTE part and an ITE part, each comprising at least one microphone ($M_{BTE}$ and $M'_{ITE}$, respectively), mounted at an ear of a user in a second configuration.

Further scope of applicability of the present disclosure will become apparent from the detailed description given hereinafter. However, it should be understood that the detailed description and specific examples, while indicating preferred embodiments of the disclosure, are given by way of illustration only. Other embodiments may become apparent to those skilled in the art from the following detailed description.

DETAILED DESCRIPTION OF EMBODIMENTS

The detailed description set forth below in connection with the appended drawings is intended as a description of various configurations. The detailed description includes specific details for the purpose of providing a thorough understanding of various concepts. However, it will be apparent to those skilled in the art that these concepts may be practiced without these specific details. Several aspects of the apparatus and methods are described by various blocks, functional units, modules, components, circuits, steps, processes, algorithms, etc. (collectively referred to as "elements"). Depending upon particular application, design constraints or other reasons, these elements may be implemented using electronic hardware, computer program, or any combination thereof.

The electronic hardware may include microprocessors, microcontrollers, digital signal processors (DSPs), field programmable gate arrays (FPGAs), programmable logic devices (PLDs), gated logic, discrete hardware circuits, and other suitable hardware configured to perform the various functionality described throughout this disclosure. Computer program shall be construed broadly to mean instructions, instruction sets, code, code segments, program code, programs, subprograms, software modules, applications, software applications, software packages, routines, subroutines, objects, executables, threads of execution, procedures, functions, etc., whether referred to as software, firmware, middleware, microcode, hardware description language, or otherwise.

The present application relates to the field of hearing devices, e.g. hearing aids.

This invention addresses a hearing device comprising a behind the ear (BTE) part with at least one microphone as well as an in the ear (ITE) part containing a receiver (loudspeaker) and/or at least one microphone. The ITE part may be connected to the BTE part by a connecting element, e.g. comprising a cable (e.g. including wire(s)), or the two parts may alternatively be wirelessly connected. We envision the situation where the ITE part may be physically disconnected from the BTE part, e.g. for repair or replacement in the situation that the ITE part does not work anymore.

In hearing instruments which have more than one microphone, the amplitude and/or phase characteristics typically have to be matched in order to achieve a proper directional gain in any beamforming/spatial filtering signal processing algorithm. A solution for matching the phase and/or estimating the microphone distance has previously been proposed (see e.g. US20170078805A1). Pre-matching of the microphone's amplitudes is usually done during production of the instrument. However, as the microphone in the BTE part and the microphone in the ITE part are in separate parts, matching during production of the instrument requires that the BTE part and the ITE part are paired. Even if the BTE part and the ITE part were matched in advance—which would be an expensive solution in case the BTE part has 2 microphones, because then the hearing aid consisting of a BTE and an ITE part would require 3 matched microphones—there is still an issue if the ITE part at a later stage has to be replaced: the microphone in the replaced ITE part does not match the microphone(s) in the BTE part, or the BTE part may be located at a different place due to a different wire length between the BTE and ITE parts. The present application addresses how to match the microphones in the case, where the ITE part (or the BTE-part, or at least one or the microphones of the BTE- or ITE parts) has been replaced. Detection and correction for non-intended orientation of the microphone axis of a BTE-part comprising two microphones has been dealt with in US20150230036A1.

Figure 1A:
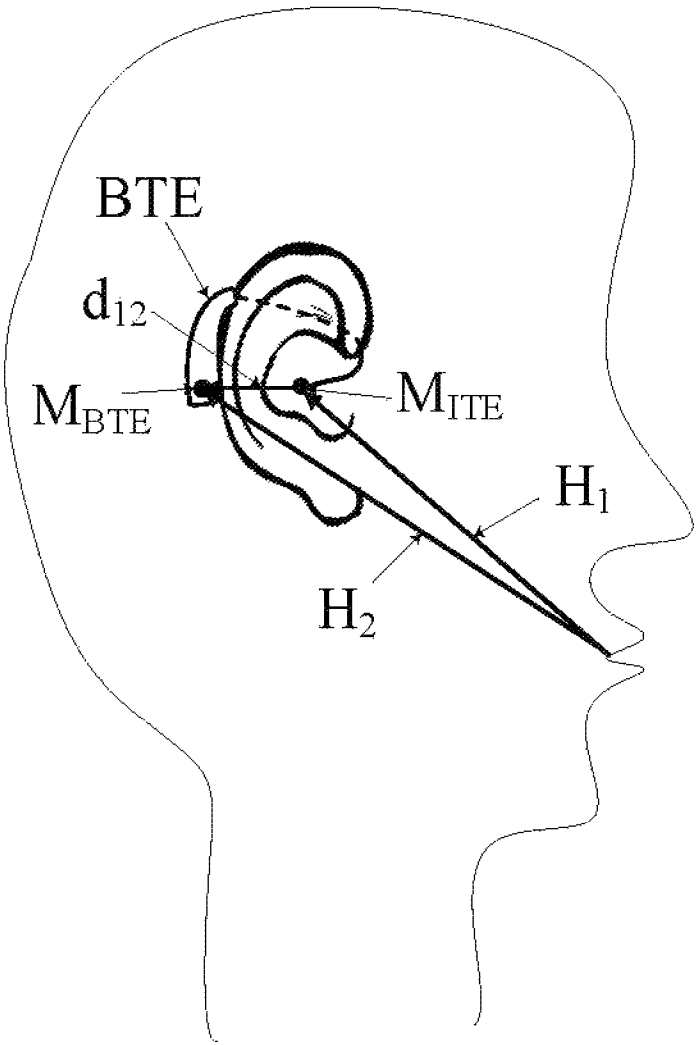
FIG. 1A shows a hearing device comprising a BTE part and an ITE part, each comprising at least one microphone ($M_{BTE}$ and $M_{ITE}$, respectively), mounted at an ear of a user in a first configuration.

FIGS. 1A and 1B shows a hearing device containing a (first) ITE part and a (second) BTE part in two different configurations. The BTE part (e.g. adapted to be located at or behind pinna) contains at least one microphone ($M_{BTE}$), and the ITE part (e.g. adapted to be located at or in an ear canal of the user) also contains at least one microphone (and possible a receiver (=loudspeaker)). $H_1$ denotes the acoustic transfer function from the mouth to the ITE microphone ($M_{ITE}$) and $H_2$ denotes the acoustic transfer function from the mouth to the BTE microphone ($M_{BTE}$). Thus $H_1$ and $H_2$ can (each) be decomposed into two parts, i) the transfer function ($H_{ac}$) between the mouth and the microphone, and ii) a microphone part ($H_{mic}$) describing the characteristics of the microphone. Let us define a so-called mouth-to-microphones look vector d, i.e., a frequency-dependent vector, which is proportional to a vector consisting of $H_1$ and $H_2$ evaluated at a particular frequency (k). For example, for each frequency channel (e.g. k=1, . . . , K, where k is a frequency index, and K are the number of channels (or bands)) in the case of two microphones, where $H_1$ and $H_2$ are complex numbers, we have $$d \propto \begin{bmatrix} H_1 \\ H_2 \end{bmatrix} \propto \begin{bmatrix} H_1/H_2 \\ 1 \end{bmatrix}$$

where we in the latter expression have assumed that the second microphone ($M_{BTE}$) is a reference microphone, so that the individual elements of the look vector d are normalized with the transfer function $H_2$ from the audio source (mouth) to the second microphone ($M_{BTE}$) (hence the '$H_1/H_2$' and '1' for the first and second elements in the expression for the look vector d). We imagine that d is estimated for each frequency channel when hearing aid(s) is (are) mounted on the ears of the hearing aid user and using the hearing aid user's own voice as sound source. This could happen during a fitting session with a hearing care professional (HCP), who runs a calibration routine where the look vector d is estimated as the hearing aid user speaks a test sentence. Afterwards the estimated d values are stored as reference values ($d_{,ref}$) in a memory of the hearing aid(s). The shown normalization (relative to $H_2$) is just one example. We may as well select other normalizations, e.g. normalize with respect to $H_1$ or normalize such that the length of d equals 1. In the following, the 'look vector' is termed d and the element of the look vector (for a two microphone case) are termed $d_{11}$ and $d_{21}$ such that $d=[d_{11}, d_{21}]^T$. In the case of a normalized look vector, we may just refer to the non-unit element as d, i.e. $d=[1, d]^T$ or $d=[d, 1]^T$.

An advantage of using the (second) BTE-microphone as a reference microphone is that it is less likely to be exchanged during the lifetime of the hearing aid than the (first) ITE microphone.

FIG. 1A illustrates a first situation with a given combination of BTE- and ITE-parts (and thus microphones ($M_{BTE}$, $M_{ITE}$) with given characteristics).

The frequency (f) dependent transfer functions $H_1$ and $H_2$ for sound from the user's mouth to respective first and second electric input signals can be considered as comprising a part $H_{ac}(f)$ accounting for the acoustic propagation path and a part accounting for the microphone characteristics $H_{mic}(f)$. $H_{ac}(f)$ represents the acoustic propagation from a sound source to a reference microphone. Hereby $H_j=H_{ac}\cdot H_{j,mic}$, where $H_{j,mic}=1$ for j=ref. In this framework, the first and second transfer functions $H_1$ and $H_2$ can be written as $H_j=H_{j,ac}\cdot H_{j,mic}$, where j is a microphone index, here j=1, 2.

It should be mentioned that the hearing device may comprise more than two input transducers (e.g. microphones), e.g. located in respective BTE and ITE-parts, or elsewhere on the user's body.

Now, if, for example, the ITE part (or the ITE-microphone) is replaced by another ITE part (or another ITE-microphone) (FIG. 1B) with a different microphone $M'_{ITE}$, the transfer function $H'_1$ ($H'_1=H'_{ITE}$) is changed compared to $H_1=H_{ITE}$) due to the different microphone characteristics. The microphone part changes (from $H_{ITE,mic}$ to $H'_{ITE,mic}$), whereas the acoustic part remains the same ($H'_{ITE,ac}=H_{ITE,ac}$) (if we assume that the placement of the ITE-microphone at the ear is identical to the previous configuration (FIG. 1A), i.e. that e.g. the cable length between the BTE and ITE parts is unaltered). Any beamformer/spatial filter algorithm, which makes use of the changed microphone would most likely loose performance, as the new microphone is not matched with respect to the microphone(s) of the BTE part (assuming that the signals from as least one BTE- and at least one ITE microphone are used by the beamformer).

Re-matching of the replaced microphone—and hence restoration of the beamformer performance—may be achieved as follows. Recall that the reference look vector d, which was estimated during the person's own voice (with microphone $M_{ITE}$ before the ITE part is replaced), is stored in the memory of the hearing aid. We may estimate the characteristics of the changed ITE microphone ($M'_{ITE}$) by decreasing, e.g. minimizing, the difference between the look vector estimated during the person's own voice d' using the changed microphone ($M'_{ITE}$), and the reference look vector d stored in hearing aid memory. This could, e.g., be achieved by applying a, generally complex-valued, frequency-dependent scaling factor to the replaced ITE microphone output (cf. $\alpha_{ITE}$ in FIG. 6) such that the squared difference $\|d-\alpha_1 d'\|^2$ is minimized (where the (second) BTE microphone is taken as the reference microphone), i.e.

$$\alpha_1 = \underset{\alpha_1}{\operatorname{argmin}}\|d - \alpha_1 d'\|^2.$$

In other words, a microphone matching function is applied to the new (first) microphone ($M'_{ITE}$), which restores the mouth-to-microphone transfer function of the old (replaced) microphone ($M_{ITE}$). This method assumes that the replaced microphone (as well as the other microphones are located at the same position). Using the microphone output of the ITE part, matched in this way, restores (or, at least increases) the beamformer/spatial filter performance.

When wearing two hearing devices, and due to the symmetry of the head, the own voice look vectors d related to the left and right device, respectively, should not differ too much. In the case, where the ITE microphone at one instrument must be replaced, the look vector obtained at the opposite (matched) hearing device may be used as reference own voice look vector.

Assuming that $d_{left}$ and $d_{right}$ were similar before an ITE microphone was replaced, due to similar locations, any difference between the left and right own voice transfer functions after an ITE microphone is replaced will be due to a different microphone response (if both ITE microphones are replaced simultaneously, this is not necessarily the case, though).

Ideally, the person's own voice estimate should be independent of the ITE microphones, as the microphones may be replaced, but an own voice estimate could e.g. depend on the BTE microphones on each ear and/or on characteristics of the person's voice. During telephone conversations, the microphone matching should not adapt if the phone is near the ear as reflections from the phone may change the estimated look vector.

The advantage of this scheme is that we may calibrate the hearing device seamlessly, without any cognitive load imposed on the hearing aid user, as the system is updated while the person is talking.

The method may also be applied for matching of regular hearing devices, given that a reference own voice look vector is available. If, e.g., we have recorded a personal own voice look vector $d_{ov,ref}$ while the microphones are matched, the own voice look vector will change over time, in case the microphones responses changes. We can compensate for this change as we know how the ideal own voice transfer function looks like ($d_{ov,ref}$).

Adaptive beamforming in hearing instruments aims at cancelling unwanted noise under the constraint that sounds from the target direction is unaltered. An example of such an adaptive system is illustrated in FIG. 2, where the output signal in the k'th frequency channel Y(k) is based on a linear combination of two fixed beamformers $C_1(k)=O$ and $C_2(k)=C$, i.e. $Y(k)=C_1(k)-\beta(k)\ C_2(k)=O-\beta C$, where $C_2(k)=C$ is a target cancelling beamformer, and $C_1(k)$ and $C_2(k)$ are orthogonal beamformers, and while $C_1(k)=O$ preserves the target direction, $C_2(k)$ is a beamformer, which cancels sound from the target direction (cf. arrow denoted Target sound in FIG. 2).

The present beamformer structure ($Y=C_1-\beta C_2$) has the advantage that the factor β responsible for noise reduction is only multiplied on the second (target-cancelling) beam pattern $C_2$ (so that the signal received from the target direction is not affected by any value of β). This constraint of a Minimum Variance Distortionless Response (MVDR) beamformer is a built in feature of the generalized sidelobe canceller (GSC) structure.

Figure 2:
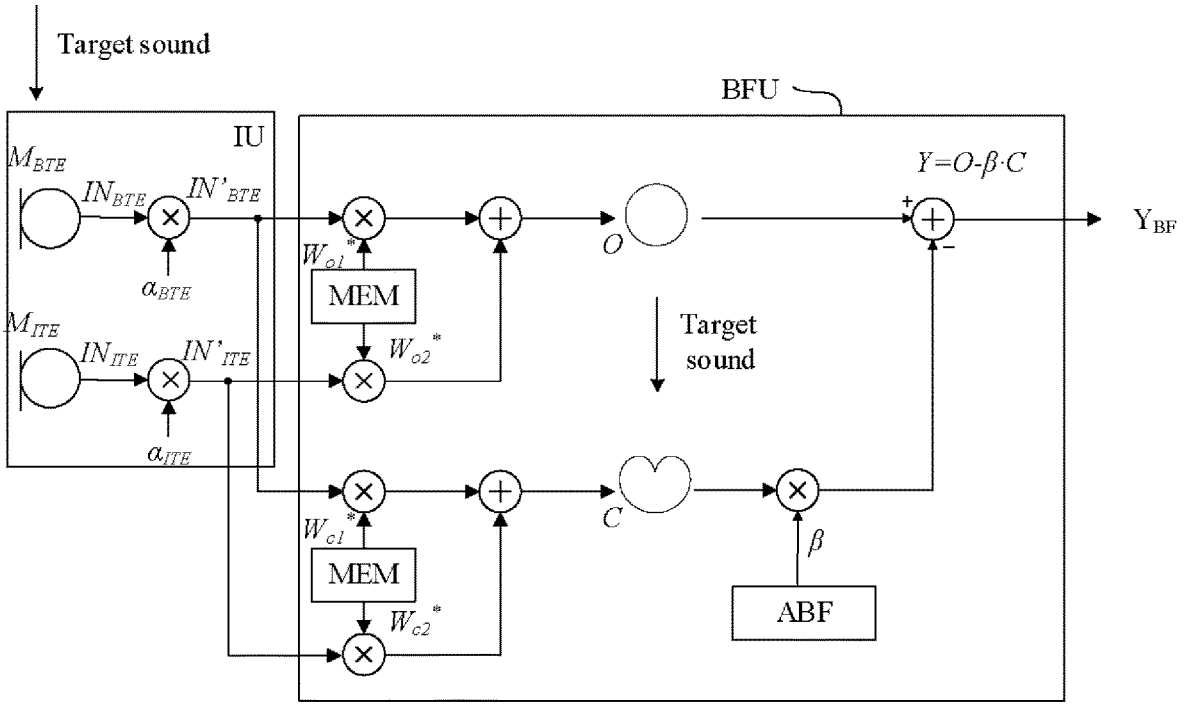
FIG. 2 shows an embodiment of a two-microphone MVDR beamformer according to the present disclosure.

FIG. 2 shows an embodiment of a two-microphone MVDR beamformer according to the present disclosure. Based on the two microphones, two fixed beamformers are created: a beamformer $C_1$ which do not alter the signal from the target direction (the mouth of the user), and an (orthogonal) beamformer $C_2$ which cancels the signal from the target direction. The resulting directional signal $Y(k)=O(k)-\beta(k)C(k)$, where $$\beta(k) = \frac{\langle C0\rangle}{\langle |C|^2\rangle + c}$$

is an adaptively determined, frequency dependent, complex parameter that minimizes the noise under the constraint that the signal from the target direction is unaltered, and where c is a constant. The determination of β is performed in unit ABF.

The adaptation factor β(k) is a weight applied to the target cancelling beamformer. Hereby, we can adapt β(k) knowing that the target direction is unaltered.

FIG. 2 shows an input unit (IU) providing electric input signals ($IN'_{BTE}$, $IN'_{ITE}$) to a beamformer filtering unit (BFU) providing a beamformed signal $Y_{BF}$ ($=Y=O-\beta C$). The beamformed signal is in the embodiment of FIG. 2 provided as a weighted combination of two microphone matched input signals $IN'_{BTE}$, $IN'_{ITE}$. The microphone matched input signals $IN'_{BTE}$, $IN'_{ITE}$ are generated based on electric input signals $IN_{BTE}$, $IN_{ITE}$ from respective BTE- and ITE-microphones ($M_{BTE}$, $M_{ITE}$) that have been multiplied by respective corrective (calibration) constants ($\alpha_{BTE}$, $\alpha_{ITE}$) to implement a microphone matching of the resulting input signals (cf. also FIG. 3, 6, 8). Each microphone path thus comprises a combination unit (here multiplication unit 'x') configured to apply (possibly complex) multiplication constants ($\alpha_{BTE}$, $\alpha_{ITE}$) to the electric input signals $IN_{BTE}$, $IN_{ITE}$ from the microphones ($M_{BTE}$, $M_{ITE}$). In other words, $IN'_{BTE}$, $=\alpha_{BTE}$ $IN_{BTE}$, and $IN'_{ITE}=\alpha_{ITE}$ $IN_{ITE}$. One of the multiplication constants ($\alpha_{BTE}$, $\alpha_{ITE}$) may be equal to 1. The two beamformers O and C are determined from the microphone matched signals $IN'_{BTE}$, $IN'_{ITE}$ based on fixed beamformer weights ($W^*_{o1}$, $W^*_{o2}$, for the target maintaining beamformer O, and $W^*_{c1}$, $W^*_{c2}$, for the target cancelling beamformer C) stored in memory a (MEM) of the hearing device. In other words, the beamformer is determined as $$O=IN'_{BTE}\cdot W^*_{o1}+IN'_{ITE}\cdot W^*_{o2}, \text{ and } C=IN'_{BTE}\cdot W^*_{c1}+IN'_{ITE}\cdot W^*_{c2},$$

Figure 3:
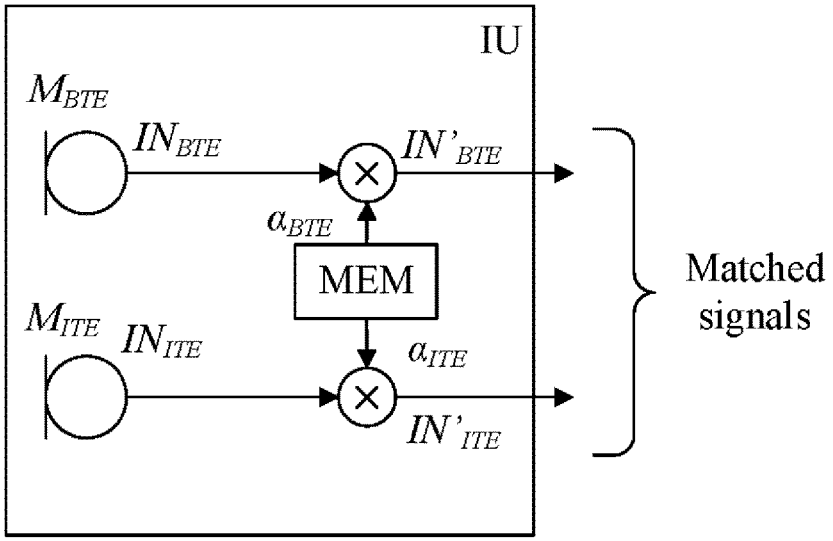
FIG. 3 shows an input unit comprising an exemplary configuration for compensating for changes in the electrical characteristics of first and second input transduces of a hearing device according to the present disclosure.

FIG. 3 shows an embodiment of an input unit (IU) for a hearing device according to the present disclosure. The input unit (IU) comprises an exemplary configuration for compensating for changes in the electrical characteristics of first and second input transduces of a hearing device (and/or their location relative to sound sources in the environment) according to the present disclosure. The input unit (IU) comprises respective BTE- and ITE-microphones ($M_{BTE}$, $M_{ITE}$) providing respective electric input signals $IN_{BTE}$, $IN_{ITE}$. The input unit (IU) further comprises a memory (MEM) storing respective multiplication constants ($\alpha_{BTE}$, $\alpha_{ITE}$) for providing microphone matching. The multiplication constants ($\alpha_{BTE}$, $\alpha_{ITE}$) are e.g. determined according to the present disclosure using a calibration procedure while the user's own voice is present. The input unit (IU) provides respective matched electric input signals $IN'_{BTE}$, $IN'_{ITE}$ (denoted 'Matched signals' in FIG. 3), where $IN'_{BTE}$, $=\alpha_{BTE}$ $IN_{BTE}$, and $IN'_{ITE}=\alpha_{ITE}$ $IN_{ITE}$.

Figure 4A:
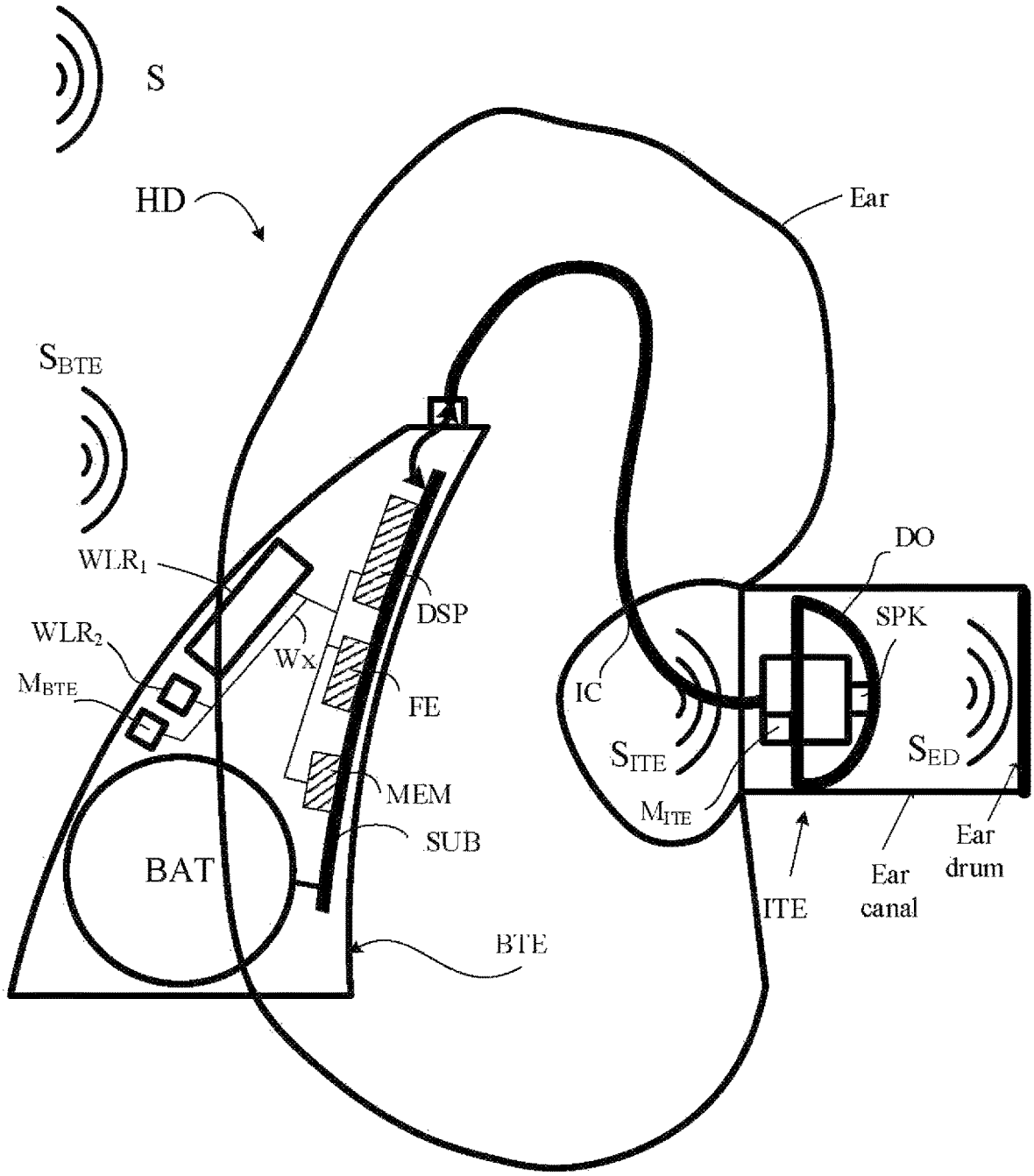
FIG. 4A shows a first embodiment of a hearing device according to the present disclosure.
Figure 4B:
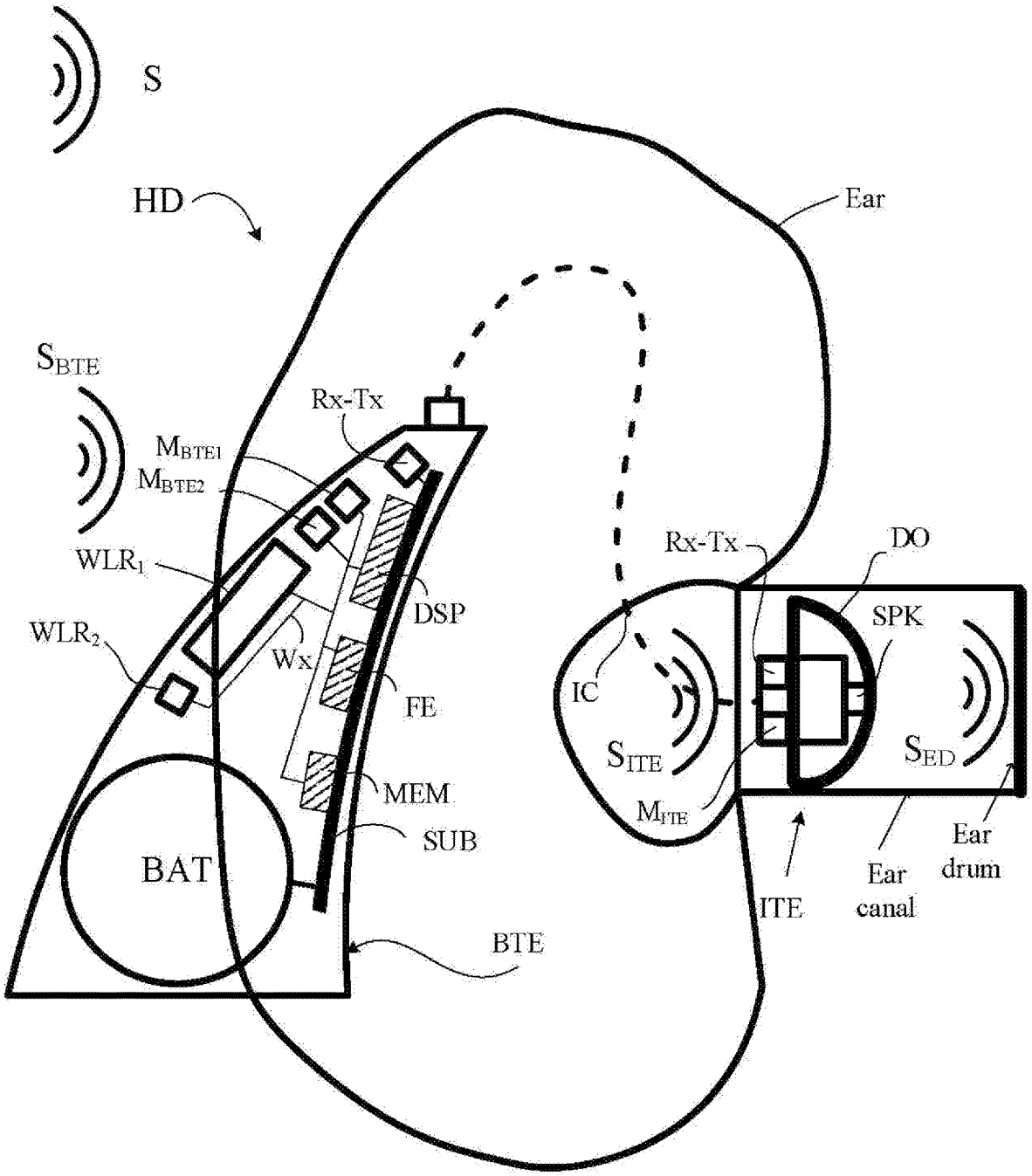
FIG. 4B shows a second embodiment of a hearing device according to the present disclosure.
Figure 4C:
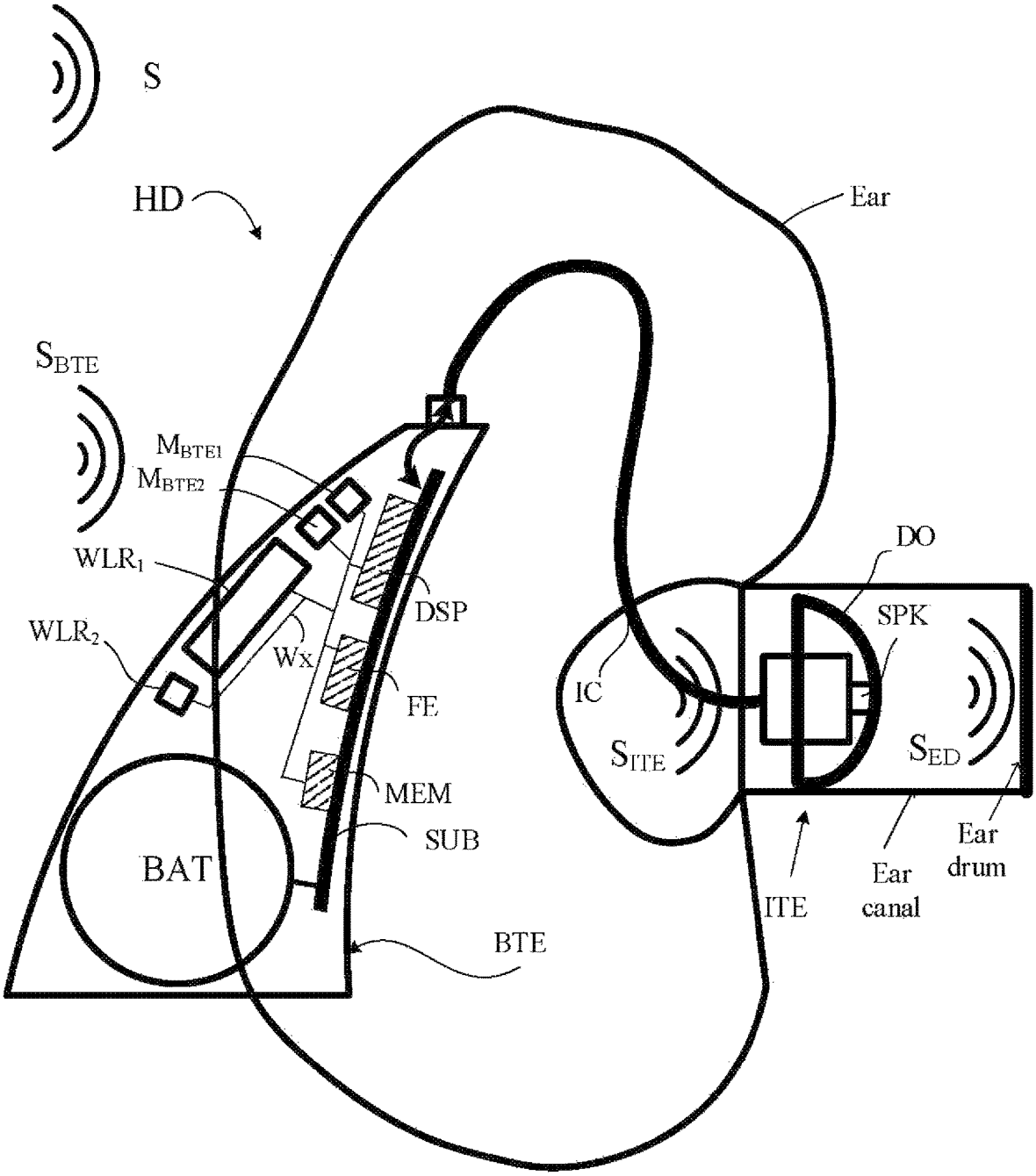
FIG. 4C shows a third embodiment of a hearing device according to the present disclosure.

FIGS. 4A 4B, and 4C each shows an exemplary hearing device according to the present disclosure. The hearing device (HD), e.g. a hearing aid, is of a particular style (sometimes termed receiver-in-the ear, or RITE, style) comprising a BTE-part (BTE) adapted for being located at or behind an ear of a user and an ITE-part (ITE) adapted for being located in or at an ear canal of a user's ear and comprising an output transducer (SPK), e.g. a receiver (loudspeaker). The BTE-part and the ITE-part are connected (e.g. electrically connected) by a connecting element (IC) and internal wiring in the ITE- and BTE-parts (cf. e.g. schematically illustrated as wiring Wx in the BTE-part). The BTE- and ITE-parts each comprise an input transducer, e.g. a microphone ($M_{BTE}$ and $M_{ITE}$), respectively, which are used to pick up sounds from the environment of a user wearing the hearing device. In an embodiment, the ITE-part is relatively open allowing air to pass through and/or around it thereby minimizing the occlusion effect perceived by the user. In an embodiment, the ITE-part according to the present disclosure is less open than a typical RITE-style comprising only a loudspeaker (SPK) and a dome (DO) to position the loudspeaker in the ear canal (cf. FIG. 4C). In an embodiment, the ITE-part according to the present disclosure comprises a mould and is intended to allow a relatively large sound pressure level to be delivered to the ear drum of the user (e.g. a user having a severe-to-profound hearing loss).

In the embodiments of a hearing device (HD) in FIGS. 4A, 4B and 4C, the hearing device (HD) comprises an input unit (IU) comprising two or more input transducers (e.g. microphones) (in each for providing an electric input audio signal representative of an input sound signal and a microphone matching arrangement as e.g. illustrated in FIG. 3. The input unit further comprises two (e.g. individually selectable) wireless receivers ($WLR_1$, $WLR_2$) for providing respective directly received auxiliary audio input and/or control or information signals. The BTE-part comprises a substrate SUB whereon a number of electronic components (MEM, FE, DSP) are mounted. The BTE-part comprises a configurable signal processor (DSP) and memory (MEM) accessible therefrom. In an embodiment, the signal processor (DSP) form part of an integrated circuit, e.g. a (mainly) digital integrated circuit.

The hearing device (HD) comprises an output transducer (SPK) providing an enhanced output signal as stimuli perceivable by the user as sound based on an enhanced audio signal from the signal processor (DSP) or a signal derived therefrom. Alternatively or additionally, the enhanced audio signal from the signal processor (DSP) may be further processed and/or transmitted to another device depending on the specific application scenario.

In the embodiment of a hearing device in FIGS. 4A, 4B and 4C, the ITE part comprises the output unit in the form of a loudspeaker (receiver) (SPK) for converting an electric signal to an acoustic signal. The ITE-part of the embodiments of FIGS. 4A and 4B also comprises the (first) input transducer ($M_{ITE}$, e.g. a microphone) for picking up a sound from the environment. The (first) input transducer ($M_{ITE}$) may—depending on the acoustic environment—pick up more or less sound from the output transducer (SPK) (unintentional acoustic feedback). The ITE-part further comprises a guiding element, e.g. a dome or mould or micro-mould (DO) for guiding and positioning the ITE-part in the ear canal (Ear canal) of the user.

In the scenario of FIGS. 4A, 4B and 4C, a (far-field) (target) sound source S is propagated (and mixed with other sounds of the environment) to respective sound fields at the BTE microphone ($M_{BTE}$) of the BTE-part SITE at the ITE microphone ($M_{ITE}$) of the ITE-part, and $S_{ED}$ at the ear drum (Ear drum)

Each of the hearing devices (HD) exemplified in FIGS. 4A, 4B, and 4C represent a portable device and further comprises a battery (BAT), e.g. a rechargeable battery, for energizing electronic components of the BTE- and ITE-parts. The hearing device of FIGS. 4A and 4B may in various embodiments implement the embodiment of a hearing device shown in FIG. 6.

In an embodiment, the hearing device (HD), e.g. a hearing aid (e.g. the processor (DSP)), is adapted to provide a frequency dependent gain and/or a level dependent compression and/or a transposition (with or without frequency compression) of one or frequency ranges to one or more other frequency ranges, e.g. to compensate for a hearing impairment of a user.

The hearing device of FIG. 4A contains two input transducers ($M_{BTE}$ and $M_{ITE}$), e.g. microphones, one ($M_{ITE}$, in the ITE-part) is located in or at the ear canal of a user and the other ($M_{BTE}$, in the BTE-part) is located elsewhere at the ear of the user (e.g. behind the ear (pinna) of the user), when the hearing device is operationally mounted on the head of the user. In the embodiment of FIG. 4A, the hearing device is configured to provide that the two input transducers ($M_{BTE}$ and $M_{ITE}$) are located along a substantially horizontal line (OL) when the hearing device is mounted at the ear of the user in a normal, operational state (cf. e.g. input transducers IN1, IN2 and dashed, double arrowed, dashed line OL in FIG. 4A). This has the advantage of facilitating beamforming of the electric input signals from the input transducers in an appropriate (horizontal) direction, e.g. in the 'look direction' of the user (e.g. towards a target sound source).

The embodiment of a hearing device shown in FIG. 4B is largely identical to the embodiment shown in FIG. 4A except for the following differences. The embodiment of a hearing device shown in FIG. 4B comprises three input transducers ($M_{BTE1}$, $M_{BTE2}$, $M_{ITE}$) (instead of two in FIG. 4A). The two BTE-microphones ($M_{BTE1}$, $M_{BTE2}$) are located in the top part of the BTE-part instead of along the line OL in FIG. 4A. In the embodiment of FIG. 4B, the two BTE-microphones ($M_{BTE1}$, $M_{BTE2}$) of the BTE-part are located in a typical state of the art BTE manner, so that—during wear of the hearing device—the two input transducers (e.g. microphones) are positioned along a horizontal line pointing substantially in a look direction of the user at the top of pinna (whereby the two input transducers in FIG. 4B can be seen as 'front' ($M_{BTE1}$) and 'rear' ($M_{BTE2}$) input transducers, respectively). The location of the three microphones has the advantage that a directional signal based on the three microphones can be flexibly provided. In an embodiment, the hearing device (HD) comprises a beamformer filtering unit (BFU) for combining at least two (possibly all three) electric input signals from the three input transducers ($M_{BTE1}$, $M_{BTE2}$, $M_{ITE}$). The at least two electric input signals preferably comprise at least the electric input signal from the ITE-microphone $M_{ITE}$.

Figure 6:
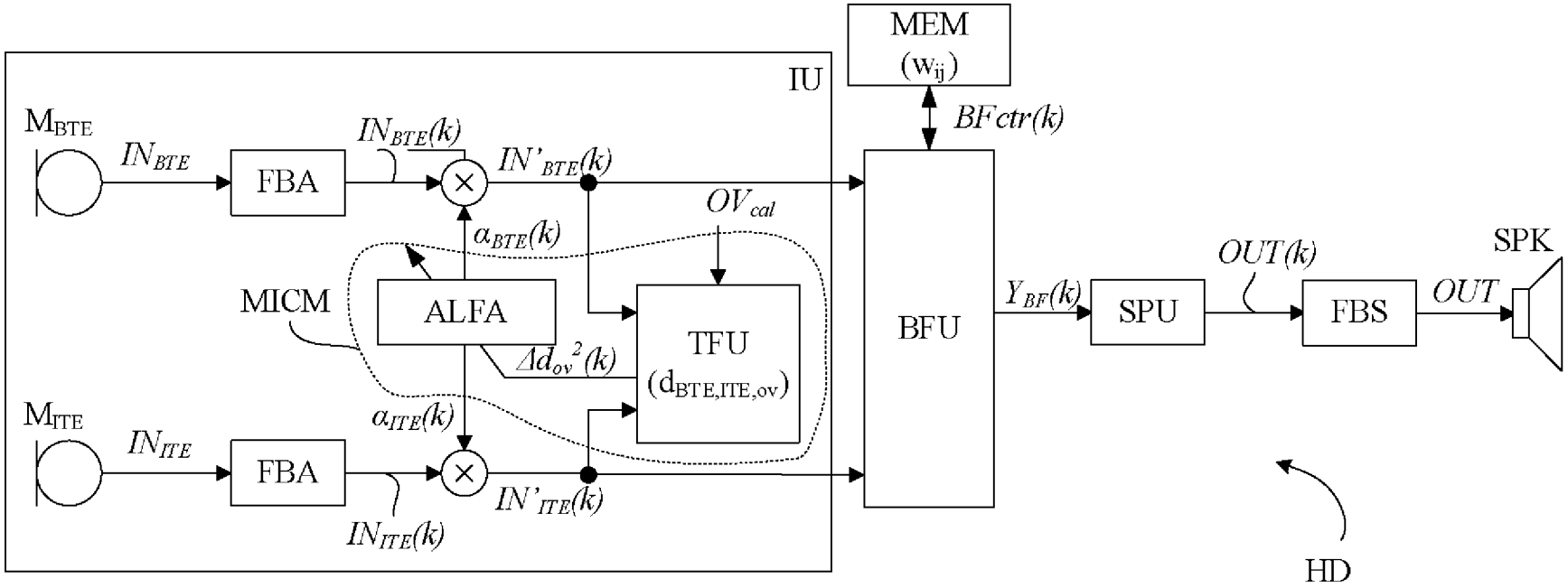
FIG. 6 shows a fourth embodiment of a hearing device according to the present disclosure.

The embodiment, of FIG. 4B further comprises antenna and transceiver circuitry (Rx-Tx) for allowing wireless exchange of signals between the BTE- and ITE-parts (e.g. transfer of the electrical signal $IN_{ITE}$ from the ITE-microphone ($M_{ITE}$) to the BTE part, e.g. for being used by a beamformer filtering unit (BFU), cf. e.g. FIG. 2, and/or for transferring the enhanced signal OUT from the processor (SPU) of the BTE-part to the loudspeaker (SPK) of the ITE-part, cf. e.g. FIG. 6). The BTE- and ITE-part may (or may not) be mechanically connected by connecting element IC (cf. dashed curved line in FIG. 4B between the two parts).

The embodiment of a hearing device shown in FIG. 4C is largely identical to the embodiment shown in FIG. 4B except for the following differences. In the embodiment of a hearing device shown in FIG. 4C the ITE-part does not comprise any input transducer, and the electrical connection between the BTE-part and the ITE part (e.g. the electric signal for being converted to stimuli of the user's ear drum by the loudspeaker SPK) is provided by an electrical cable provided by connecting element (IC).

Figure 5A:
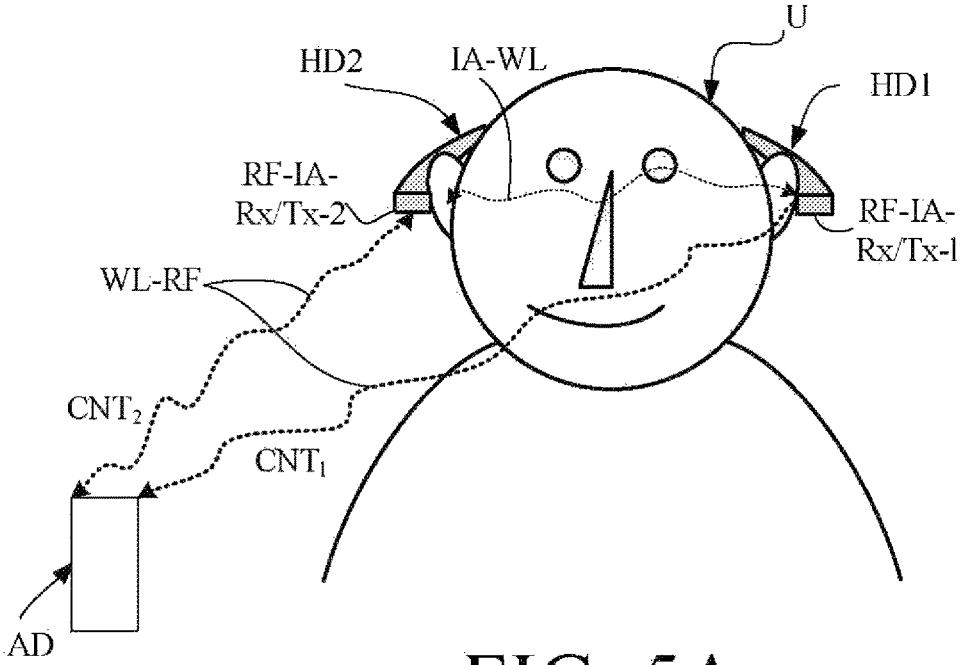
FIG. 5A shows a first embodiment of a binaural hearing system comprising first and second hearing devices and an auxiliary device comprising a user interface for the hearing system.
Figure 5B:
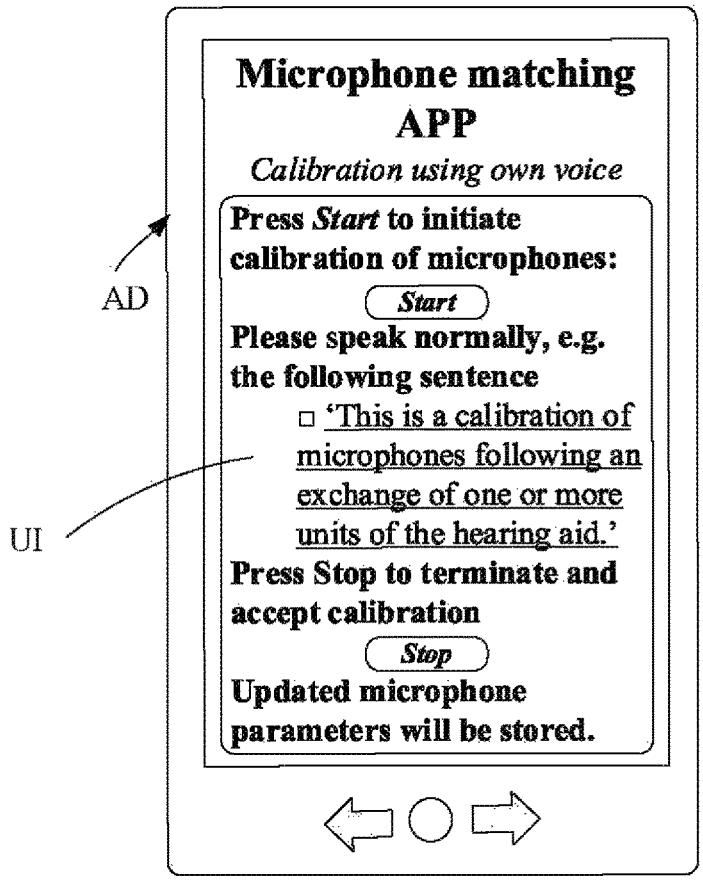
FIG. 5B illustrates a Microphone matching APP running on the auxiliary device implementing an exemplary part of a user interface for the hearing system.

FIG. 5A shows an embodiment of a binaural hearing system comprising first and second hearing devices ($HD_1$, $HD_2$) worn by a user (U) and an auxiliary device (AD) comprising a user interface (UI) for the hearing system. FIG. 5A, 5B show an exemplary application scenario of an embodiment of a hearing system according to the present disclosure. FIG. 5B illustrates the auxiliary device (AD) running an APP for performing microphone matching (calibration) procedure. The APP is a non-transitory application (APP) comprising executable instructions configured to be executed on the auxiliary device to implement a user interface (UI) for the hearing device(s) (HD1, HD2) or the hearing system. In the illustrated embodiment, the APP is configured to run on a smartphone, or on another portable device allowing communication with the hearing device(s) or the hearing system.

In the embodiment of FIG. 5A, wireless link denoted IA-WL (e.g. an inductive link) between the hearing left and right assistance devices, and wireless links denoted WL-RF (e.g. RF-links (e.g. Bluetooth)) between the auxiliary device (AD) and the left (HD1) hearing device and between the auxiliary device (AD) and the right (HD2) hearing device, respectively, are indicated. The wireless links are implemented in the devices by corresponding antenna and transceiver circuitry, indicated in FIG. 5A in the left and right hearing devices as RF-IA-Rx/Tx-1 and RF-IA-Rx/Tx-2, respectively.

FIG. 5B illustrates a user interface (UI) implemented as an APP according to the present disclosure running on the auxiliary device (AD). The user interface comprises a display (e.g. a touch sensitive display). Via the display of the user interface, the user can interact with the hearing system and hence control functionality of the system. The illustrated screen of the 'Microphone matching-APP' allows the user to activate a calibration mode (according to the present disclosure), cf. 'Calibration using own voice'. The screen contains instructions to the user to initiate the calibration, cf. instruction 'Press Start to initiate calibration of microphones' and following Start button. The screen further contains instructions to the user to 'Please speak normally, e.g. the following sentence: □ 'This is a calibration of microphones following an exchange of one or more units of the hearing aid'. The screen further contains instructions to the user to 'Press Stop to terminate and accept calibration' followed by a 'Stop' button. The screen further contains information to the user that (after the calibration procedure has been carried out), 'Updated microphone parameters will be stored'. In an embodiment the hearing instrument(s) measures (and logs) the direction of gravity during the calibration procedure, e.g. by use of an accelerometer. Different directions of gravity between the hearing instruments (compared to a reference difference) could indicate that not only the ITE response has changed after the ITE part has been replaced, but also the BTE response has been changed (e.g. due to a different receiver length).

The auxiliary device (AD) comprising the user interface (UI) is preferably adapted for being held in a hand of a user (U).

In an embodiment, the auxiliary device (AD) is or comprises a smartphone or similar device. In an embodiment, the auxiliary device (AD) is or comprises an audio gateway device adapted for receiving a multitude of audio signals (e.g. from an entertainment device, e.g. a TV or a music player, a telephone apparatus, e.g. a mobile telephone or a computer, e.g. a PC) and adapted for selecting and/or combining an appropriate one of the received audio signals (or combination of signals) for transmission to the hearing device. In an embodiment, the auxiliary device (AD) is or comprises a remote control for controlling functionality and operation of the hearing device(s). In an embodiment, the function of a remote control is implemented in a smartphone, the smartphone possibly running an APP allowing to control functionality of the audio processing device via the smartphone (the hearing device(s) comprising an appropriate wireless interface to the smartphone, e.g. based on Bluetooth or some other standardized or proprietary scheme).

FIG. 6 shows a hearing device (HD) according to the present disclosure. The hearing device comprises an input unit comprising at least two microphones ($M_{BTE}$, $M_{ITE}$) for picking up sound from the environment and providing corresponding electric input signals ($IN_{BTE}$, $IN_{ITE}$) and a microphone matching arrangement (MMU, ALFA and combination units 'X') for providing microphone matching according to the present disclosure. The input unit (IU) provides at least two electric input signals representing matched electric input signals ($IN'_{BTE}$, $IN'_{ITE}$) from the at least two microphones ($M_{BTE}$, $M_{ITE}$). The hearing device further comprises a beamformer filtering unit (BFU) coupled to a memory (MEM) containing fixed and/or adaptively updated beamformer weights ($w_{ij}$) and for providing a beamformed signal $Y_{BF}$ based on the matched electric input signals ($IN'_{BTE}$, $IN'_{ITE}$) or processed versions thereof. The hearing device (HD) further comprises a signal processor (SPU) for processing the beamformed signal $Y_{BF}$ (e.g. for applying further processing algorithms to the signal, e.g. further noise reduction, compressive amplification, etc.) and providing a processed output signal OUT. In the embodiment of FIG. 6, the processing is assumed to be conducted in a frequency sub-band representation (cf. frequency sub-band index k). The hearing device (HD) hence further comprises a synthesis filter bank for converting the processed frequency sub-band signal OUT(k) to a time domain signal OUT, which is fed to an output transducer, here a loudspeaker (SPK) for being converted to sound stimuli propagated to a user's ear drum.

The input unit (IU) of the embodiment of FIG. 6 comprises the same elements as the input unit of the embodiment of FIG. 3, namely a number of microphones (here two, $M_{BTE}$, $M_{ITE}$) and two combination units ('X') for applying respective correction (or calibration) factors ($\alpha_{BTE}$, $\alpha_{ITE}$) to the electric input signals ($IN_{BTE}$, $IN_{ITE}$) from the microphones ($M_{BTE}$, $M_{ITE}$), respectively, to provide corresponding microphone matched signal ($IN'_{BTE}$, $IN'_{ITE}$), which are used for further processing, e.g. fed to beamformer filtering unit (BFU). In the embodiment of FIG. 6, each of the microphone paths of the input unit (UI) comprises respective analysis filter banks (FBA) for providing a frequency sub-band representation ($IN_{BTE}(k)$, $IN_{ITE}(k)$, where k is a frequency band index) of the (time domain) electric input signals ($IN_{BTE}$, $IN_{ITE}$) (which are assumed to have been digitized by appropriate analogue to digital converters). The frequency sub-band representations of the electric input signals ($IN_{BTE}(k)$, $IN_{ITE}(k)$) are fed to respective multiplication units ('X') where appropriate calibration factors ($\alpha_{BTE}$, $\alpha_{ITE}$) are applied to provide microphone matched frequency sub-band signals ($IN'_{BTE}(k)$, $IN'_{ITE}(k)$), which are fed to the beamformer filtering unit BFU. The microphone matched frequency sub-band signals ($IN'_{BTE}(k)$, $IN'_{ITE}(k)$) are further fed to transfer function comparison unit (TFU) wherein a reference value $d_{BTE,ITE,ov}$ of the own voice look vector $d_{ov}$ is stored. In a specific calibration mode (controlled by trigger signal $OV_{cal}$), where the user's own voice is present (preferably dominant), cf. e.g. FIG. 5A, 5B, the transfer function comparison (TFU) determines a present value $d'_{BTE,ITE,ov}$ of the own voice look vector. In an iterative process, including adaptive modification of (at least one of) the calibration factors ($\alpha_{BTE}$, $\alpha_{ITE}$), cf. modification unit (ALFA), the calibration factors ($\alpha_{BTE}$, $\alpha_{ITE}$) that minimize the (squared) difference $\Delta d^2_{ov}(k)$ between the reference own voice look vector and the present value of the look vector are determined. The iterative microphone matching procedure is handled by the transfer function comparison unit (TFU) and the calibration factor modification unit (ALFA), together constituting or forming part of the microphone matching unit (denoted MICM) as indicated by the dotted enclosure in FIG. 6. In case the BTE microphone is chosen as reference microphone, the calibration factor ($\alpha_{BTE}$) for the BTE-microphone signal $IN_{BTE}$ is 1 and the microphone matching only relies on the calibration factor ($\alpha_{ITE}$) for the ITE-microphone signal $IN_{ITE}$. The expression that is minimized is in that case $\Delta d_{ov}^2(k)=\|d_{BTE\text{-}ITE,ov,ref}(k)-\alpha_{ITE}d'_{BTE\text{-}ITE,ov}(k)\|^2$. In other words, the calibration factor ($\alpha_{ITE}$) for the ITE microphone signal is determined as $$\alpha_{ITE} = \underset{\alpha_{ITE}}{\operatorname{argmin}}\left\|d_{BTE\text{-}ITE,ov,ref} - \alpha_{ITE}d'_{BTE\text{-}ITE,ov}\right\|^2$$

Where $$d_{ov,ref} = (H_{ITE,ov,ref} / H_{BTE,ov,ref}, 1) = (d_{BTE\text{-}ITE,ov,ref}, 1), \text{ and}$$

$$d'_{ov} = (H'_{ITE,ov} / H'_{BTE,ov}, 1) = (d'_{BTE\text{-}ITE,ov}, 1).$$

In case only the ITE part has been replaced, and the BTE part is positioned at the same place, $H_{BTE,ov,ref}=H'_{BTE_ov}$.

Figure 7A:
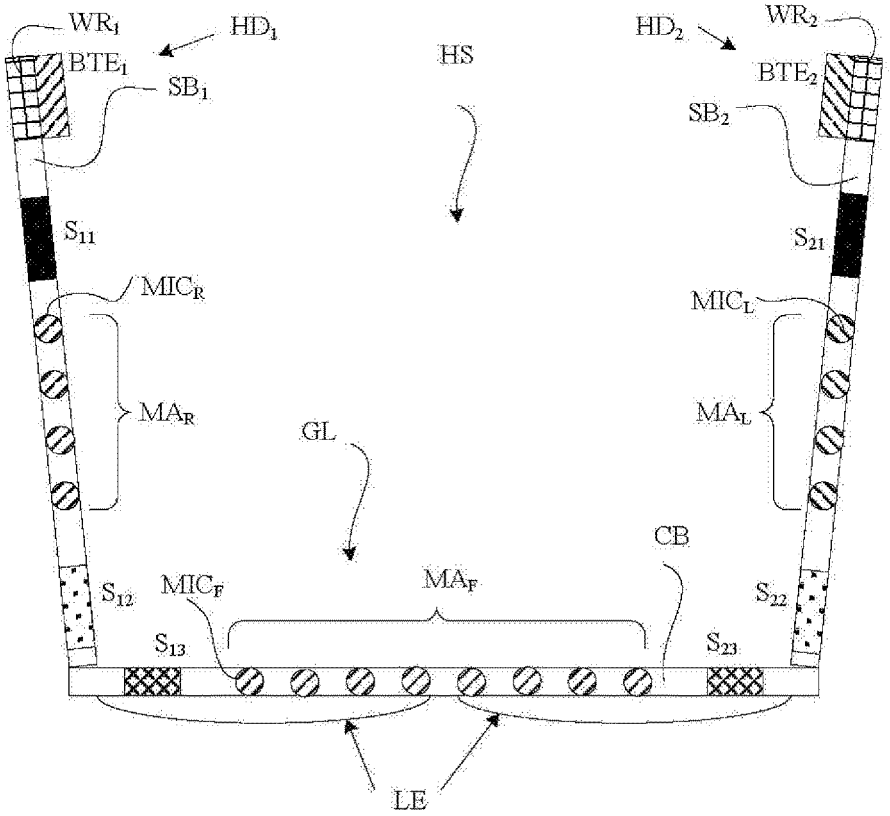
FIG. 7A shows a top view of a second embodiment of a hearing system comprising first and second hearing devices integrated with a spectacle frame.
Figure 7B:
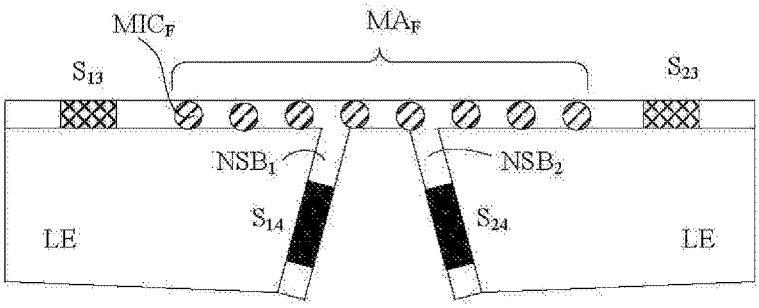
FIG. 7B shows a front view of the embodiment in FIG. 7A.

FIG. 7A shows a top view of a first embodiment of a hearing system comprising first and second hearing devices integrated with a spectacle frame. FIG. 7B shows a front view of the embodiment in FIG. 7A, and FIG. 7C shows a side view of the embodiment in FIG. 7A.

The hearing system according to the present disclosure comprises a sensor integration device configured to be worn on the head of a user comprising a head worn carrier, here embodied in a spectacle frame.

The hearing system comprises left and right hearing devices and a number of sensors mounted on the spectacle frame. The hearing system (HS) comprises a number of sensors $S_{1i}$, $S_{2i}$, (i=1, . . . , $N_S$) associated with (e.g. forming part of or connected to) left and right hearing devices ($HD_1$, $HD_2$), respectively. $N_S$ is the number of sensors located on each side of the frame (in the example of FIG. 7A, 7B, 7C assumed to be symmetric, which need not necessary be so, though). The first, second, third, and fourth sensors $S_{11}$, $S_{12}$, $S_{13}$, $S_{14}$ and $S_{21}$, $S_{22}$, $S_{23}$, $S_{24}$ are mounted on a spectacle frame of the glasses (GL). In the embodiment of FIG. 7A, sensors $S_{11}$, $S_{12}$ and $S_{21}$, $S_{22}$ are mounted on the respective sidebars ($SB_1$ and $SB_2$), whereas sensors $S_{13}$ and $S_{23}$ are mounted on the cross bar (CB) having hinged connections to the right and left side bars ($SB_1$ and $SB_2$). Finally, sensors $S_{14}$ and $S_{24}$ are mounted on first and second nose sub-bars ($NSB_1$, $NSB_2$) extending from the cross bar (CB) and adapted for resting on the nose of the user. Glasses or lenses (LE) of the spectacles are mounted on the cross bar (CB) and nose sub-bars ($NSB_1$, $NSB_2$). The left and right hearing devices ($HD_1$, $HD_2$) comprises respective BTE-parts ($BTE_1$, $BTE_2$), and further comprise respective ITE-parts ($ITE_1$, $ITE_2$). It should be noted though that replacement of an ITE part would change the transfer function between all microphones of the glasses and the replaced ITE part. In an embodiment, all microphones the system are located on the glasses and/or on the BTE part. The ITE-parts may e.g. comprise electrodes for picking up body signals from the user, e.g. forming part of sensors $S_{1i}$, $S_{2i}$ (i=1, . . . , $N_S$) for monitoring physiological functions of the user, e.g. brain activity or eye movement activity or temperature. Likewise, the one or more of the sensors on the spectacle frame may comprise electrodes for picking up body signals from the user. In an embodiment, sensors S11, S14 and S21, S24 (black rectangles) may represent sensor electrodes for picking up body signals e.g. Electrooculography (EOG) potentials and/or brainwave potentials, e.g. Electroencephalography (EEG) potentials, cf. e.g. EP3185590A1. The sensors mounted on the spectacle frame may e.g. comprise one or more of an accelerometer, a gyroscope, a magnetometer, a radar sensor, an eye camera (e.g. for monitoring pupillometry), a camera (e.g. for imaging objects of the environment of the user), or other sensors for localizing or contributing to localization of a sound source (or other landmark) of interest to the user wearing the hearing system and/or for identifying a user's own voice. The sensors ($S_{13}$, $S_{23}$) located on the cross bar (CB) and/or sensors (e.g. $S_{12}$, $S_{22}$) located on the side bars ($SB_1$, $SB_2$) may e.g. include one or more cameras or radar or ultra sound sensors for monitoring the environment and/or for identifying a user's own voice. The hearing system further comprises a multitude of microphones, here configured in three separate microphone arrays ($MA_R$, $MA_L$, $MA_F$) located on the right, left side bars and on the (front) cross bar, respectively. Each microphone array ($MA_R$, $MA_L$, $MA_F$) comprises a multitude of microphones ($MIC_R$, $MIC_L$, $MIC_F$, respectively), here four, four and eight, respectively. The microphones may form part of the hearing system (e.g. associated with the right and left hearing devices ($HD_1$, $HD_2$), respectively, and contribute to localise and spatially filter sound from the respective sound sources of the environment around the user, cf. e.g. our co-pending European patent application number 17179464.7 filed with the European Patent Office on 4 Jul. 2017 and having the title Direction Of Arrival Estimation In Miniature Devices Using A Sound Sensor Array. The use of a spectacle frame as a carrier for a number of sensors in cooperation with respective left and right BTE-parts of a hearing system is e.g. illustrated and discussed in FIG. 1A, 1B of our co-pending European patent application number 17205683.0 filed with the European Patent Office on 6 Dec. 2017 and having the title A hearing device or system adapted for navigation.

Figure 7C:
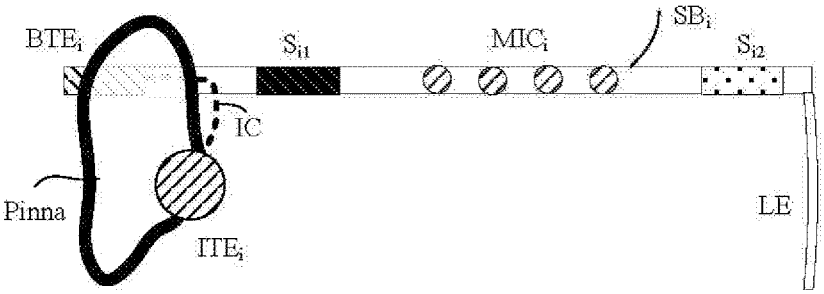
FIG. 7C shows a side view of the embodiment in FIG. 7A.

The BTE- and ITE parts (BTE and ITE) of the hearing devices are electrically connected, either wirelessly or wired, as indicated by the dashed connection between them in FIG. 7C and as exemplified in embodiments of FIG. 4A, 4B, 4C. The ITE part may comprise a microphone (cf. $M_{ITE}$ in FIGS. 4A, 4B) and/or a loudspeaker (cf. SPK in FIG. 4A, 4B, 4C) located in the ear canal during use. One or more of the microphones ($MIC_L$, $MIC_R$, $MIC_F$) on the spectacle frame may take the place of the BTE microphone(s) of the embodiments of FIG. 4A, 4B, 4C. Alternatively or additionally, the BTE-part(s) of the embodiment of FIGS. 7A, 7B and 7C may comprise further microphones ($M_{BTEp}$).

Figure 8:
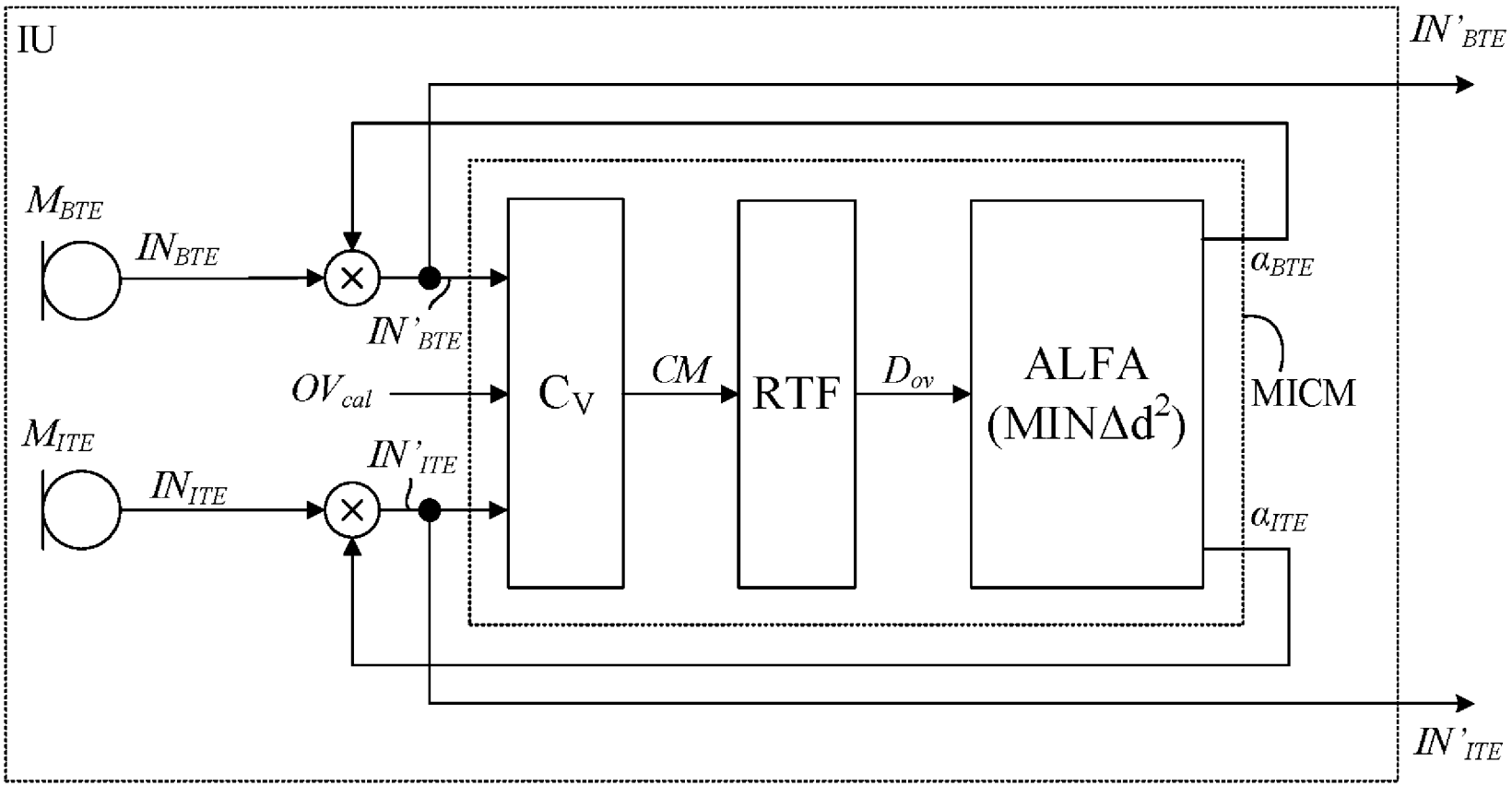
FIG. 8 shows an embodiment of an input unit comprising a microphone matching unit according to the present disclosure.

FIG. 8 shows an embodiment of an input unit comprising a microphone matching unit according to the present disclosure. The input unit (IU) shown in FIG. 8 is equivalent to the embodiments of an input unit illustrated in FIG. 2, 3 and FIG. 6. The embodiment of FIG. 8 comprises microphone matching unit (MICM) coupled to the microphone matched signals $IN'_{BTE}$, $IN'_{ITE}$ and providing the calibration factors ($\alpha_{BTE}$, $\alpha_{ITE}$) to the respective multiplication units ('X') of the BTE- and ITE-microphone paths. The microphone matching unit (MICM) (e.g. its activation and de-activation) is controlled by control signal $OV_{cal}$ (e.g. from a user interface, or generated (e.g. by a processor) according to a trigger criterion). In the embodiment of FIG. 8, the microphone matching unit (MICM) comprises a covariance estimation unit $C_V$ for estimating a covariance matrix for the microphone matched BTE and ITE microphone signals $IN'_{BTE}$, $IN'_{ITE}$, and based thereon (signal CM) corresponding (relative) transfer functions for the user's own voice (cf. signal $D_{ov}$) are determined by transfer function determination unit (RTF). The current transfer function (from the user's mouth, using the currently determined calibration factors) is compared to a reference transfer function in transfer function modification unit (ALFA), which is configured to determine the calibration factors ($\alpha_{BTE}$, $\alpha_{ITE}$) so that a cost function is minimized (e.g. $\Delta d^2$ as referred to above, or some other cost function). This may be implemented in an iterative procedure during a calibration mode, or using a look-up table with predefined exemplary combinations of transfer function modifications and calibration factors ($\alpha_{BTE}$, $\alpha_{ITE}$). An example of the determination of a look vector d (comprising (e.g. own voice) transfer functions) is described below.

Estimating a Look Vector or Steering Vector d:

In the case, where only the target sound is present, a recorded sound at the microphones (e.g. $M_{BTE}$ and $M_{ITE}$ in FIG. 4A) is given by $$x = \begin{bmatrix} x_1 \\ x_2 \end{bmatrix} = s * h,$$

where $$h = \begin{bmatrix} h_1 \\ h_2 \end{bmatrix}$$

is the transfer functions between the position of the source s and the microphones.

In the frequency domain, for each frequency channel k and time index m we have $$X(k, m) = \begin{bmatrix} X_1(k, m) \\ X_2(k, m) \end{bmatrix} = S(k, m)H(k, m) = S(k, m)\begin{bmatrix} H_1(k, m) \\ H_2(k, m) \end{bmatrix},$$

Omitting the frequency index k, we may estimate a covariance matrix as $$\hat{C} = \langle XX^H \rangle = \frac{1}{N}\sum_{m=1}^{N} X(m)X^H(m).$$

Where N is a time index (e.g. time frame index). The covariance matrix may as well be estimated recursively. If the sound from the look direction is the only sound, the covariance matrix is given by $C=HH^H$, where H is the vector given by $$H = \begin{bmatrix} H_1(k, m) \\ H_2(k, m) \end{bmatrix},$$

but the time and frequency indices are omitted (actually, H does not change over time), and the steering vector is proportional to any of the columns of H, e.g. the normalized steering vector becomes $$d = \begin{bmatrix} 1 \\ C_{21}/C_{11} \end{bmatrix}.$$

If noise is present, but known, the procedure described in EP3300078A1 can be applied. Alternatively, normalization is performed w.r.t the second element:

$$d = \begin{bmatrix} C_{11}/C_{21} \\ 1 \end{bmatrix}.$$

This normalization is more appropriate if the first microphone has been replaced.

In the previous examples (except FIG. 4C), focus has been on so-called receiver-in-the-ear-(RITE-) type hearing aids, for which the in-the-ear-part (ITE) comprises a receiver (loudspeaker) as well as a microphone. In the example of FIG. 4C, the ITE part does not contain a microphone. The concepts of the present invention may still be valuable for such setup, however. In case wire length of the connecting element (IC in FIG. 4C) changes, e.g. if the receiver is exchanged and the wire length changes with it (by accident or at will), the location of the BTE-part will typically change, whereby the transfer function(s) from the mouth to the microphones (of the BTE-part) changes. Hence, a calibration of the microphone matching according to the present disclosure may be advantageous. In an embodiment, the hearing device comprises a detection unit for detecting a length or a change of length of the connecting element (e.g. a cable comprising two or more electric conductors, e.g. wires). In an embodiment, a microphone matching according to the present disclosure is initiated upon detection of a change of length of the connecting element between the first and second parts of the hearing device. A change of length of the connecting element has influence on a number of important functions of a hearing device, including beamforming (beamformer weights should be calibrated), feedback estimation/cancellation (normal feedback path(s) change(s)).

It is intended that the structural features of the devices described above, either in the detailed description and/or in the claims, may be combined with steps of the method, when appropriately substituted by a corresponding process.

As used, the singular forms "a," "an," and "the" are intended to include the plural forms as well (i.e. to have the meaning "at least one"), unless expressly stated otherwise. It will be further understood that the terms "includes," "comprises," "including," and/or "comprising," when used in this specification, specify the presence of stated features, integers, steps, operations, elements, and/or components, but do not preclude the presence or addition of one or more other features, integers, steps, operations, elements, components, and/or groups thereof. It will also be understood that when an element is referred to as being "connected" or "coupled" to another element, it can be directly connected or coupled to the other element but an intervening element may also be present, unless expressly stated otherwise. Furthermore, "connected" or "coupled" as used herein may include wirelessly connected or coupled. As used herein, the term "and/or" includes any and all combinations of one or more of the associated listed items. The steps of any disclosed method is not limited to the exact order stated herein, unless expressly stated otherwise.

It should be appreciated that reference throughout this specification to "one embodiment" or "an embodiment" or "an aspect" or features included as "may" means that a particular feature, structure or characteristic described in connection with the embodiment is included in at least one embodiment of the disclosure. Furthermore, the particular features, structures or characteristics may be combined as suitable in one or more embodiments of the disclosure. The previous description is provided to enable any person skilled in the art to practice the various aspects described herein. Various modifications to these aspects will be readily apparent to those skilled in the art, and the generic principles defined herein may be applied to other aspects.

The claims are not intended to be limited to the aspects shown herein, but is to be accorded the full scope consistent with the language of the claims, wherein reference to an element in the singular is not intended to mean "one and only one" unless specifically so stated, but rather "one or more." Unless specifically stated otherwise, the term "some" refers to one or more.

Accordingly, the scope should be judged in terms of the claims that follow.

REFERENCES

US20170078805A1 (OTICON) 16 Mar. 2017
EP2882204B1 (OTICON) 12 Oct. 2016
EP2701145A1 (OTICON) 26 Feb. 2014
US20150230036A1 (OTICON) 13 Aug. 2015
US2006262944A1 (OTICON) 23 Nov. 2006
US2008189107A1 (OTICON) 7 Aug. 2008
EP3300078A1 (OTICON) 28 Mar. 2018

The invention claimed is:

1. A hearing device configured to be worn by a user, the hearing device comprising first and second separate parts, the first part comprising a first input transducer providing a first electric input signal representative of sound in an environment of the user, and the second part comprising a second input transducer providing a second electric input signal representative of sound in the environment of the user, wherein the first and second parts are electrically connectable with each other via a wired or wireless connection, and wherein the hearing device further comprises a beamformer filtering unit configured to receive said first and second electric input signals and to provide a spatially filtered signal based thereon;

comprises or has access to a memory comprising a previously determined own voice transfer function corresponding to a target sound source located at said user's mouth;

wherein said hearing device is configured to determine an updated own voice transfer function according to activation of a predefined trigger, when the user's own voice is present, and to store an updated own voice transfer function, e.g. a relative transfer function, in said memory, and at least one combination unit configured to apply a first multiplication factor to at least one of said first and second electric input signals, and a control unit configured to determine said first, possibly complex, multiplication factor so as to decrease a difference measure representative of a difference between said previously determined own voice transfer function and said updated own voice transfer function.

2. A hearing device according to claim 1 wherein the control unit configured to determine said first, possibly complex, multiplication factor so as to minimize a difference measure representative of a difference between said previously determined own voice transfer function and said updated own voice transfer function.

3. A hearing device according to claim 1 wherein the first part is or comprises an ITE part configured to be located at or in an ear canal of the user.

4. A hearing device according to claim 1 wherein the second part is or comprises a BTE part configured to be located at or behind an ear of the user.

5. A hearing device according to claim 1, wherein the second part contains or comprises two input transducers.

6. A hearing device according to claim 5, wherein the two input transducers comprise microphones.

7. A hearing device according to claim 1 comprising a connecting element configured to electrically connect the first and second parts via one or more electrical conductors.

8. A hearing device according to claim 1 configured to provide that said predefined trigger is activated by a power on of the hearing device.

9. A hearing device according to claim 1 configured to provide that said predefined trigger is activated when said first and second units are electrically connected after having been electrically disconnected.

10. A hearing device according to claim 1 configured to provide that said predefined trigger is activated when said first and/or said second input transducers have been replaced.

11. A hearing device according to claim 1 configured to provide that re-matching of a replaced first or second input transducer is provided by replacing a previously used own voice look vector d stored in said memory, by an updated own voice look vector d', said updated own voice look vector d' being determined by applying a, generally complex-valued, frequency-dependent scaling factor to the electric input signal of the replaced first or second input transducer such that the squared difference $\|d-\alpha_1 d'\|^2$ is minimized.

12. A hearing device according to claim 1 comprising an own voice detector for estimating whether or not, or with what probability, a given input sound originates from the voice of the user of the hearing device.

13. A hearing device according to claim 1 constituting or comprising a hearing aid, a headset, an earphone, an ear protection device or a combination thereof.

14. A non-transitory computer-readable medium storing an application, termed an APP, comprising executable instructions configured to be executed on an auxiliary device to implement a user interface for a hearing device according to claim 1.

15. A hearing system comprising a hearing device according to claim 1 AND an auxiliary device, wherein the hearing system is adapted to establish a communication link between the hearing device and the auxiliary device to provide that information can be exchanged or forwarded from one to the other.

16. A method of matching input transducers of a hearing device configured to be worn by a user, the hearing device comprising first and second separate parts, the first part comprising a first input transducer providing a first electric input signal representative of sound in an environment of the user, and the second part comprising a second input transducer providing a second electric input signal representative of sound in the environment of the user, wherein the first and second parts are electrically connectable with each other via a wired or wireless connection, the method comprising receiving said first and second electric input signals;

providing a spatially filtered signal based on said first and second electric input signals;

storing previously determined own voice beamformer weights or an own voice transfer function corresponding to a previously determined or reference own voice beamformer adapted to pick up said user's own voice;

updating said own voice beamformer weights or said own voice transfer function according to activation of a predefined trigger, when the user's own voice is present;

storing said updated own voice beamformer weights or said updated own voice transfer function in said memory;

providing matched first and second electric input signals based on said previously determined own voice beamformer weights or own voice transfer function and said updated own voice beamformer weights or own voice transfer function.

17. A method according to claim 16 wherein said predefined trigger may be generated via a user interface and/or by a signal from one or more sensors.

18. A method according to claim 16 wherein said hearing device constitutes or comprises a hearing aid, a headset, an earphone, an ear protection device or a combination thereof.

19. A computer program comprising instructions which, when the program is executed by a computer, cause the computer to carry out the method of claim 16.

20. A non-transitory computer-readable medium storing an application, termed an APP, comprising executable instructions configured to be executed on an auxiliary device to implement a user interface for a hearing device and configured to activate and/or control a microphone matching (calibration) procedure according to claim 16.

* * * * *